US012426637B2

(12) United States Patent
Short et al.

(10) Patent No.: US 12,426,637 B2
(45) Date of Patent: Sep. 30, 2025

(54) INDUCTIVELY HEATED AEROSOL DELIVERY DEVICE CONSUMABLE

(71) Applicant: RAI Strategic Holdings, Inc., Winston-Salem, NC (US)

(72) Inventors: Jason M. Short, Winston-Salem, NC (US); Jason L. Wood, Lexington, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 733 days.

(21) Appl. No.: 17/404,650

(22) Filed: Aug. 17, 2021

(65) Prior Publication Data

US 2023/0056177 A1 Feb. 23, 2023

(51) Int. Cl.

| | |
|---|---|
| ***A24F 40/485*** | (2020.01) |
| ***A24F 40/10*** | (2020.01) |
| ***A24F 40/42*** | (2020.01) |
| ***A24F 40/465*** | (2020.01) |

(52) U.S. Cl.

CPC ..... *A24F 40/485* (2020.01); *A24F 40/10* (2020.01); *A24F 40/42* (2020.01); *A24F 40/465* (2020.01)

(58) Field of Classification Search

None

See application file for complete search history.

(56) References Cited

U.S. PATENT DOCUMENTS

| | | | |
|---|---|---|---|
| 1,464,300 | A | 8/1923 | Taff |
| 1,505,655 | A | 8/1924 | Marek |
| 1,541,891 | A | 6/1925 | Becker |
| 1,607,132 | A | 11/1926 | Kuno |
| 1,613,545 | A | 1/1927 | Teigen |
| 1,941,531 | A | 1/1934 | Blankenship |
| 2,008,433 | A | 7/1935 | Ashour |
| 2,373,629 | A | 4/1945 | Kilgore |

(Continued)

FOREIGN PATENT DOCUMENTS

| | | | | |
|---|---|---|---|---|
| JP | 2002-034543 | | 2/2002 | |
| KR | 20190140480 | A * | 12/2019 | ..... A24F 47/008 |

(Continued)

OTHER PUBLICATIONS

WIPO, International Search Report for PCT/IB2022/057713 dated Nov. 8, 2022, pp. 1-139.

*Primary Examiner* — Michael J Felton

(74) *Attorney, Agent, or Firm* — Womble Bond Dickinson (US) LLP

(57) ABSTRACT

The present disclosure is directed to an aerosol delivery device and a holder for use with a removable cartridge. The holder includes a main body defining a receiving chamber configured to receive the cartridge, and a resonant transmitter located proximate at least a portion of the receiving chamber. The removable cartridge includes a reservoir containing an aerosol precursor composition, a liquid transport element, and a susceptor having an active portion around which at least a second end of the liquid transport element extends, at least the active portion of the susceptor being arranged to heat the second end of the liquid transport element and thereby heat aerosol precursor composition therein to form the aerosol. Opposing ends of the susceptor circumferentially and axially position the active portion of the susceptor within the cartridge.

9 Claims, 11 Drawing Sheets

(56) References Cited

U.S. PATENT DOCUMENTS 2,455,492 A 12/1948 Jackson
2,502,831 A 4/1950 Henry
2,541,837 A 2/1951 Joseph
2,701,571 A 2/1955 Dittrich
2,711,176 A 6/1955 Vakilian
2,779,340 A 1/1957 Lee
2,953,136 A 9/1960 Dahly
3,155,099 A 11/1964 Minchin
3,181,538 A 5/1965 Piliego
3,685,520 A 8/1972 Chernack
4,708,151 A 11/1987 Shelar
4,714,082 A 12/1987 Banerjee et al.
4,966,171 A 10/1990 Serrano et al.
4,991,606 A 2/1991 Serrano et al.
5,040,552 A 8/1991 Schleich et al.
5,060,676 A 10/1991 Hearn et al.
5,076,296 A 12/1991 Nystrom et al.
5,159,940 A 11/1992 Hayward et al.
5,178,165 A 1/1993 DeFelice
5,240,012 A 8/1993 Ehrman et al.
5,592,955 A 1/1997 Keritsis
5,595,577 A 1/1997 Bensalem et al.
5,692,525 A 12/1997 Counts et al.
5,845,649 A 12/1998 Saito et al.
6,006,757 A 12/1999 Lichtenberg
6,053,176 A 4/2000 Adams et al.
6,164,287 A 12/2000 White
6,311,694 B1 11/2001 Nichols et al.
6,345,625 B1 2/2002 Chew
6,371,127 B1 4/2002 Snaidr et al.
6,431,177 B1 8/2002 Sieggen et al.
6,532,965 B1 3/2003 Abhulimen et al.
6,615,843 B2 9/2003 Pera
6,748,955 B2 6/2004 Snaidr et al.
7,080,649 B2 7/2006 Hcu
7,503,330 B2 3/2009 Borschke et al.
7,600,517 B1 10/2009 Holzrichter
7,624,739 B2 12/2009 Snaidr et al.
8,061,361 B2 11/2011 Maeder et al.
8,151,803 B2 4/2012 Inagaki
8,302,611 B2 11/2012 Rowley
8,528,567 B2 9/2013 Hajaligol
8,616,217 B2 12/2013 Tsurizumi et al.
8,776,803 B2 7/2014 Tarora et al.
8,863,754 B2 10/2014 Renaud et al.
8,915,255 B2 12/2014 Poget et al.
9,078,473 B2 7/2015 Worm et al.
9,149,072 B2 10/2015 Conner et al.
9,220,301 B2 12/2015 Banerjee et al.
9,282,769 B2 3/2016 Mishra et al.
9,301,546 B2 4/2016 Thomas et al.
9,332,784 B2 5/2016 Banerjee et al.
9,439,453 B2 9/2016 Conner et al.
9,532,591 B2 1/2017 Mironov
9,549,572 B2 1/2017 Dincer et al.
9,609,893 B2 4/2017 Novak, III et al.
9,629,393 B2 4/2017 Stolz et al.
9,693,587 B2 7/2017 Plojoux
9,717,273 B2 8/2017 Poget et al.
9,730,468 B2 8/2017 Poget et al.
9,801,412 B2 10/2017 Grant
9,894,930 B2 2/2018 Bonici et al.
9,918,494 B2 3/2018 Mironov et al.
9,930,915 B2 4/2018 Worm et al.
9,943,114 B2 4/2018 Batista
9,961,939 B2 5/2018 Reevell
10,022,014 B2 7/2018 Mateos Martin et al.
10,034,493 B2 7/2018 Akiyama et al.
10,062,015 B2 8/2018 Besehanic
10,064,428 B2 9/2018 Swepston et al.
10,064,478 B2 9/2018 Brooks
10,082,015 B2 9/2018 Williams et al.
10,102,013 B2 10/2018 Preston et al.
10,111,463 B2 10/2018 Batista
10,132,009 B2 11/2018 Chou et al.
10,159,277 B2 12/2018 Bonnely
10,212,014 B2 2/2019 Qu et al.
10,212,968 B2 2/2019 Mironov et al.
10,222,015 B2 3/2019 Chien
10,262,017 B2 4/2019 Wolge
10,291,991 B2 5/2019 Shan et al.
10,301,990 B2 5/2019 De Smet et al.
10,302,018 B2 5/2019 Venter
10,312,017 B2 6/2019 Huang et al.
10,398,168 B2 9/2019 Maiwald et al.
10,470,491 B2 11/2019 Sutton et al.
10,492,526 B2 12/2019 Sampson et al.
10,524,503 B2 1/2020 Florack et al.
10,827,780 B2 11/2020 Swepston et al.
2008/0047570 A1 2/2008 Plank
2009/0065011 A1 3/2009 Maeder et al.
2011/0083674 A1 4/2011 Karpinsky
2011/0277757 A1* 11/2011 Terry ..... A61M 11/042 128/202.21
2013/0133675 A1 5/2013 Shinozaki et al.
2013/0167850 A1 7/2013 Al-Aawar
2013/0228190 A1 9/2013 Weiss et al.
2014/0048085 A1 2/2014 Cox
2015/0034100 A1 2/2015 Park et al.
2015/0040924 A1 2/2015 Mironov et al.
2015/0296882 A1 10/2015 Mironov et al.
2015/0342254 A1 12/2015 Mironov et al.
2016/0007648 A1 1/2016 Sutton et al.
2016/0007649 A1 1/2016 Sampson et al.
2016/0120216 A1 5/2016 Mironov et al.
2016/0135495 A1 5/2016 Poget et al.
2016/0174609 A1 6/2016 Mironov
2016/0192704 A1 7/2016 Bonnely
2016/0316816 A1 11/2016 Lavanchy et al.
2016/0360785 A1 12/2016 Bless et al.
2017/0000189 A1 1/2017 Mironov et al.
2017/0055577 A1 3/2017 Batista
2017/0055578 A1 3/2017 Oda et al.
2017/0164654 A1 6/2017 Ademe
2017/0196261 A1 7/2017 Borges De Couraca et al.
2017/0303585 A1 10/2017 Florack et al.
2017/0318859 A1 11/2017 Batista
2018/0000165 A1 1/2018 Liu
2018/0014571 A1 1/2018 Nakano
2018/0070640 A1 3/2018 Bessant et al.
2018/0116280 A1 5/2018 Maiwald et al.
2018/0146715 A1* 5/2018 Takeuchi ..... A24F 40/485
2018/0192707 A1 7/2018 Worm et al.
2018/0317560 A1 11/2018 Shinozaki et al.
2018/0325167 A1 11/2018 Grant
2018/0368468 A1 12/2018 Mishra et al.
2019/0000135 A1 1/2019 Lavanant et al.
2019/0000141 A1 1/2019 Rojo-Calderon et al.
2019/0000142 A1 1/2019 Lavanchy et al.
2019/0014818 A1 1/2019 Saygili
2019/0014820 A1 1/2019 Malgat
2019/0014821 A1 1/2019 Batista et al.
2019/0059449 A1 2/2019 Akiyama et al.
2019/0059450 A1 2/2019 Akiyama et al.
2019/0075848 A1 3/2019 Worm et al.
2019/0124972 A1 5/2019 Nakano
2019/0124973 A1 5/2019 Nakano et al.
2019/0133176 A1 5/2019 Nakano et al.
2019/0150505 A1 5/2019 Ceppi et al.
2019/0274358 A1 9/2019 Reevell
2019/0281892 A1* 9/2019 Hejazi ..... H05B 6/108
2020/0015519 A1 1/2020 Conner et al.
2020/0060333 A1 2/2020 Sutton et al.
2020/0146349 A1 5/2020 Phillips et al.
2020/0268044 A1 8/2020 Wilson
2020/0337366 A1* 10/2020 Tritz ..... A24B 15/167
2021/0015172 A1 1/2021 Conner et al.
2021/0015174 A1 1/2021 Cox et al.
2021/0015175 A1 1/2021 Jackson et al.
2021/0168911 A1* 6/2021 Hejazi ..... A24F 40/465

(56) References Cited

U.S. PATENT DOCUMENTS

| | | | | |
|---|---|---|---|---|
| 2021/0204604 | A1* | 7/2021 | Mironov | H05B 6/105 |
| 2021/0219616 | A1 | 7/2021 | Crump et al. | |

FOREIGN PATENT DOCUMENTS

| | | | |
|---|---|---|---|
| WO | WO 95/34226 | | 12/1995 |
| WO | WO 98/54989 | | 12/1998 |
| WO | WO 2009/022232 | | 2/2009 |
| WO | WO 2013/072336 | | 5/2013 |
| WO | WO 2013/083963 | | 6/2013 |
| WO | WO 2013/149810 | | 10/2013 |
| WO | WO 2013/189836 | | 12/2013 |
| WO | WO 2014/037270 | | 3/2014 |
| WO | WO 2014/156838 | | 10/2014 |
| WO | WO 2014/180893 | | 11/2014 |
| WO | WO 2015/097005 | | 7/2015 |
| WO | WO 2015/128384 | | 9/2015 |
| WO | WO 2015/151158 | | 10/2015 |
| WO | WO-2015177044 | A1 | 11/2015 |
| WO | WO 2015/184744 | | 12/2015 |
| WO | WO 2015/197850 | | 12/2015 |
| WO | WO-2017001819 | A1 | 1/2017 |
| WO | WO 2017/042297 | | 3/2017 |
| WO | WO 2017/108912 | | 6/2017 |
| WO | WO 2017/114760 | | 7/2017 |
| WO | WO 2017/115181 | | 7/2017 |
| WO | WO 2017/115182 | | 7/2017 |
| WO | WO 2017/115183 | | 7/2017 |
| WO | WO 2017/115184 | | 7/2017 |
| WO | WO 2017/115185 | | 7/2017 |
| WO | WO 2017/115188 | | 7/2017 |
| WO | WO 2017/115196 | | 7/2017 |
| WO | WO 2017/207442 | | 12/2017 |
| WO | WO 2017/212284 | | 12/2017 |
| WO | WO 2018/170800 | | 9/2018 |
| WO | WO 2018/201655 | | 11/2018 |
| WO | WO-2018201655 | A1 * | 11/2018 |
| WO | WO 2019/010680 | | 1/2019 |
| WO | WO 2020/216762 | | 10/2020 |

* cited by examiner

INDUCTIVELY HEATED AEROSOL DELIVERY DEVICE CONSUMABLE

FIELD OF THE DISCLOSURE

The present disclosure relates to aerosol delivery devices and systems, such as smoking articles; and more particularly, to aerosol delivery devices and systems that utilize an aerosol precursor composition for the production of aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles may be made or derived from tobacco, or those articles may be characterized as otherwise incorporating tobacco for human consumption, and which may be capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference in its entirety.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides reusable and/or replaceable components.

BRIEF SUMMARY

In various implementations, the present disclosure relates to aerosol delivery devices and holders for use with removable and replaceable cartridges. The present disclosure includes, without limitation, the following example implementations.

Example Implementation 1: An aerosol delivery device comprising: a cartridge comprising: a reservoir containing an aerosol precursor composition configured to form an aerosol upon application of heat thereto, a liquid transport element having a first end in fluid communication with the reservoir so as to transport the aerosol precursor composition from the reservoir and into an opposing second end of the liquid transport element; and a susceptor having an active portion around which at least the second end of the liquid transport element extends, at least the active portion of the susceptor being arranged to heat the second end of the liquid transport element and thereby heat the aerosol precursor composition therein to form the aerosol; and a holder comprising a main body defining a receiving chamber configured to receive the cartridge, and a resonant transmitter located proximate at least a portion of the receiving chamber, wherein opposing ends of the susceptor circumferentially and axially position the active portion of the susceptor within the cartridge.

Example Implementation 2: The aerosol delivery device of Example Implementation 1, or any combination of preceding example implementations, wherein the opposing ends of the susceptor circumferentially and axially position the active portion of the susceptor relative to the liquid transport element.

Example Implementation 3: The aerosol delivery device of any of Example Implementations 1-2, or any combination of preceding example implementations, wherein the cartridge includes an outer housing that at least partially circumscribes the reservoir, the liquid transport element, and the susceptor.

Example Implementation 4: The aerosol delivery device of any of Example Implementations 1-3, or any combination of preceding example implementations, wherein the opposing ends of the susceptor circumferentially and axially position the active portion of the susceptor relative to the outer housing and reservoir.

Example Implementation 5: The aerosol delivery device of any of Example Implementations 1-4, or any combination of preceding example implementations, the aerosol delivery device further comprising an end cap defining end apertures and arranged to cover a distal end of the outer housing.

Example Implementation 6: The aerosol delivery device of any of Example Implementations 1-5, or any combination of preceding example implementations, the aerosol delivery device further comprising a plug arranged relative to an opposing proximal end of the outer housing so as to cover a first open end of the reservoir, the first end of the liquid transport element extending into an opposing second open end of the reservoir.

Example Implementation 7: The aerosol delivery device of any of Example Implementations 1-6, or any combination of preceding example implementations, wherein the opposing ends of the susceptor are circumferentially turned ends with the active portion longitudinally-extending therebetween.

Example Implementation 8: The aerosol delivery device of any of Example Implementations 1-7, or any combination of preceding example implementations, wherein the liquid transport element defines an opening through which at least a portion of the susceptor extends.

Example Implementation 9: The aerosol delivery device of any of Example Implementations 1-8, or any combination of preceding example implementations, wherein the first end of the liquid transport element defines at least one opening extending from the first end of the liquid transport element and at least partially along a longitudinal length thereof, the first circumferentially turned end of the susceptor extending through the at least one opening such that the first end of the liquid transport element extends through the first circumferentially turned end of the susceptor.

Example Implementation 10: The aerosol delivery device of any of Example Implementations 1-9, or any combination of preceding example implementations, wherein the second end of the liquid transport element is wrapped around the active portion of the susceptor.

Example Implementation 11: An inductively heated cartridge for use with a holder comprising a main body defining a receiving chamber configured to receive the cartridge, the cartridge comprising: a reservoir containing an aerosol precursor composition configured to form an aerosol upon application of heat thereto, and a liquid transport element having a first end in fluid communication with the reservoir so as to transport the aerosol precursor composition from the reservoir to an opposing second end of the liquid transport element; and a susceptor having an active portion around which at least the second end of the liquid transport element extends, at least the active portion of the susceptor being arranged to heat the second end of the liquid transport element and thereby heat the aerosol precursor composition therein to form the aerosol; wherein opposing ends of the susceptor circumferentially and axially position the active portion of the susceptor within the cartridge.

Example Implementation 12: The inductively heated cartridge of Example Implementation 11, or any combination of preceding example implementations, wherein the opposing ends of the susceptor circumferentially and axially position the active portion of the susceptor relative to the liquid transport element.

Example Implementation 13: The inductively heated cartridge of any of Example Implementations 11-12, or any combination of preceding example implementations, inductively heated cartridge further comprising an outer housing that at least partially circumscribes the reservoir, the liquid transport element, and the susceptor.

Example Implementation 14: The inductively heated cartridge of any of Example Implementations 11-13, or any combination of preceding example implementations, wherein the opposing ends of the susceptor circumferentially and axially position the active portion of the susceptor with relative to the outer housing and reservoir.

Example Implementation 15: The inductively heated cartridge of any of Example Implementations 11-14, or any combination of preceding example implementations, the inductively heated cartridge further comprising an end cap defining end apertures and arranged to cover a distal end of the outer housing.

Example Implementation 16: The inductively heated cartridge of any of Example Implementations 11-15, or any combination of preceding example implementations, the inductively heated cartridge further comprising a plug arranged relative to an opposing proximal end of the outer housing so as to cover a first open end of the reservoir, the first end of the liquid transport element extending into an opposing second open end of the reservoir.

Example Implementation 17: The inductively heated cartridge of any one of Example Implementations 11-16, or any combination of preceding example implementations, wherein the opposing ends of the susceptor are circumferentially turned ends with the active portion longitudinally-extending therebetween.

Example Implementation 18: The inductively heated cartridge of any one of Example Implementations 11-17, or any combination of preceding example implementations, wherein the liquid transport element defines an opening through which at least a portion of the susceptor extends.

Example Implementation 19: The inductively heated cartridge of any one of Example Implementations 11-18, or any combination of preceding example implementations, wherein the first end of the liquid transport element defines at least one opening extending from the first end of the liquid transport element and at least partially along a longitudinal length thereof, the first circumferentially turned end of the susceptor extending through the at least one opening such that the first end of the liquid transport element extends through the first circumferentially turned end of the susceptor.

Example Implementation 20: The inductively heated cartridge of any one of Example Implementations 11-19, or any combination of preceding example implementations, wherein the second end of the liquid transport element is wrapped around the active portion of the susceptor.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Figure 1:
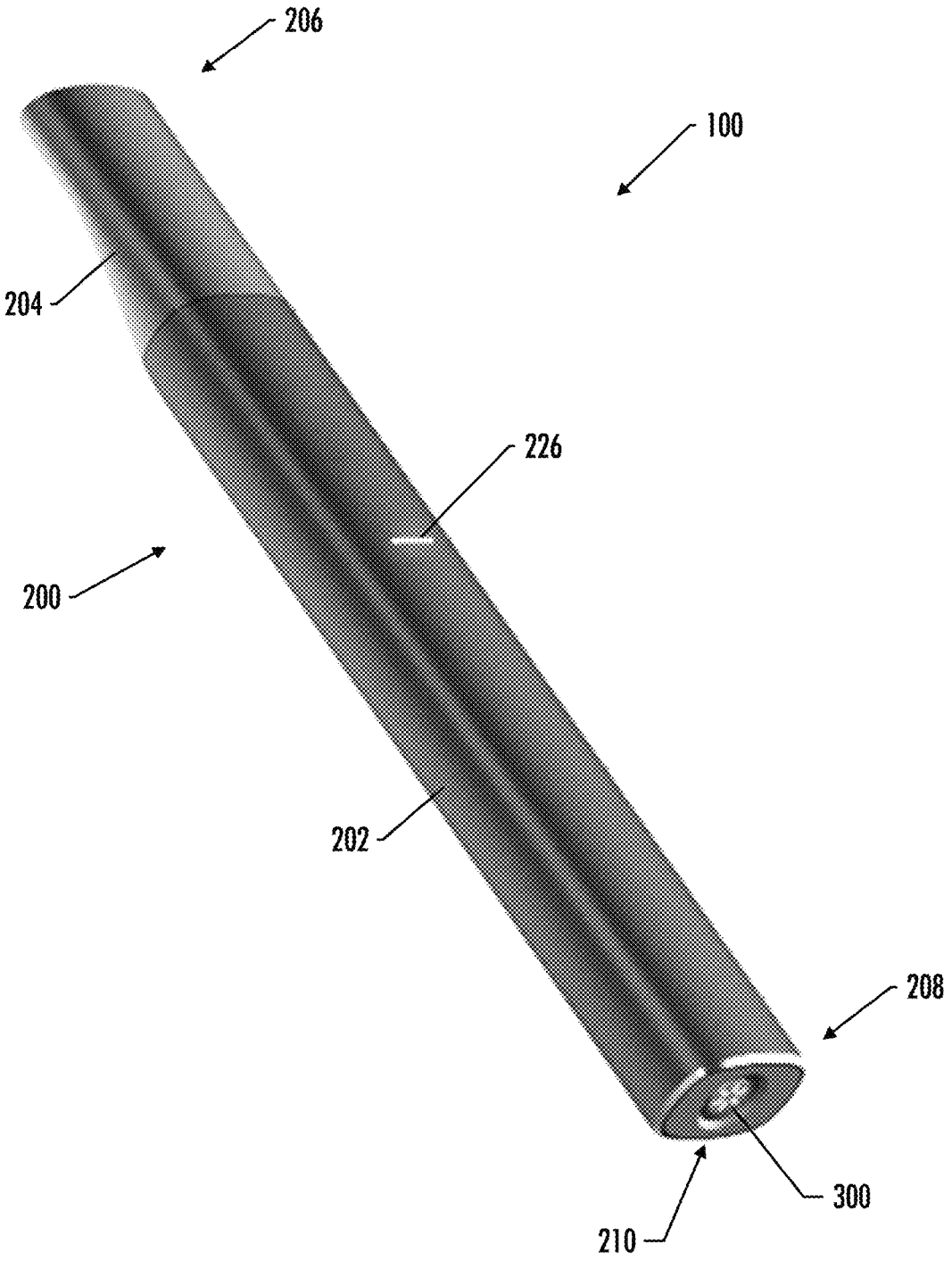
Figure 2:
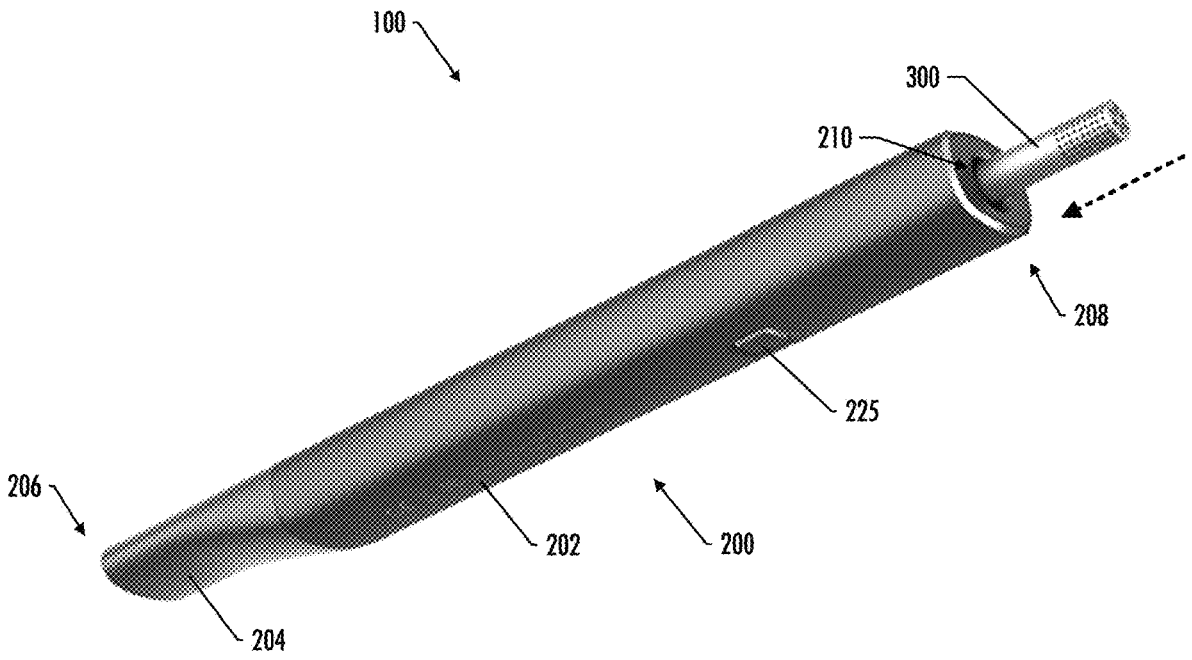
Figure 3:
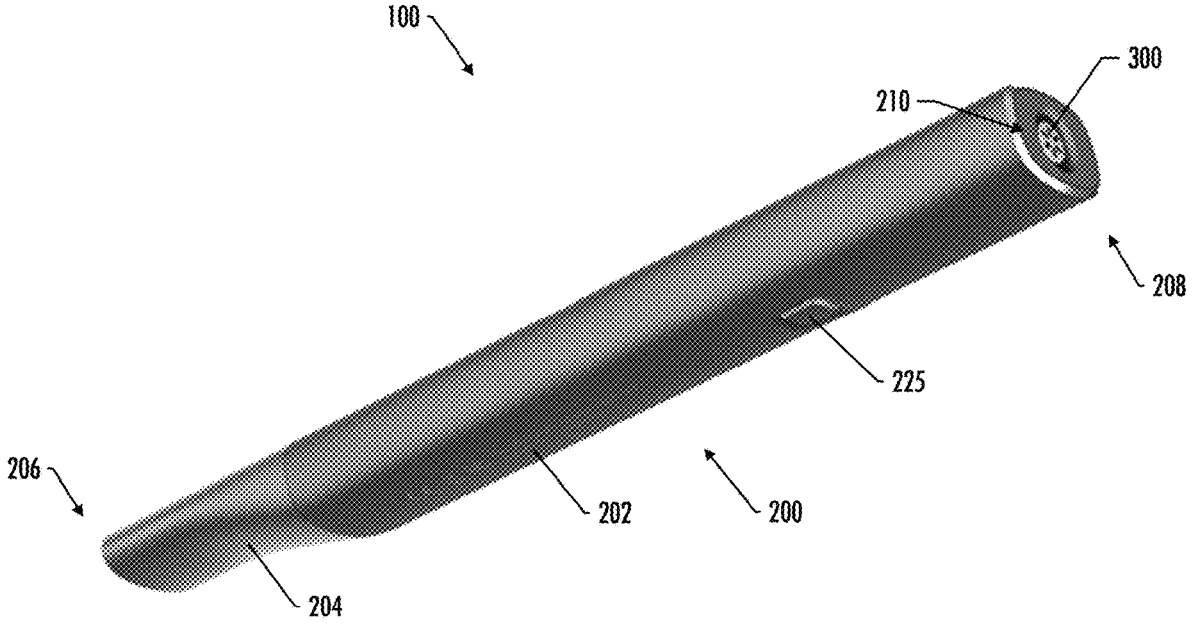
Figure 4:
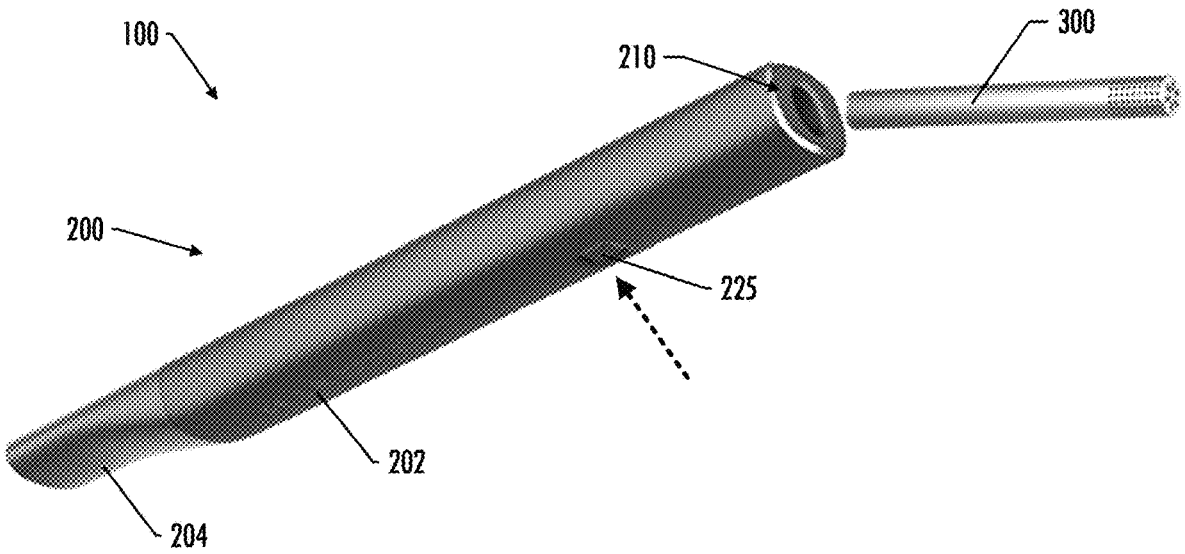
Figure 5:
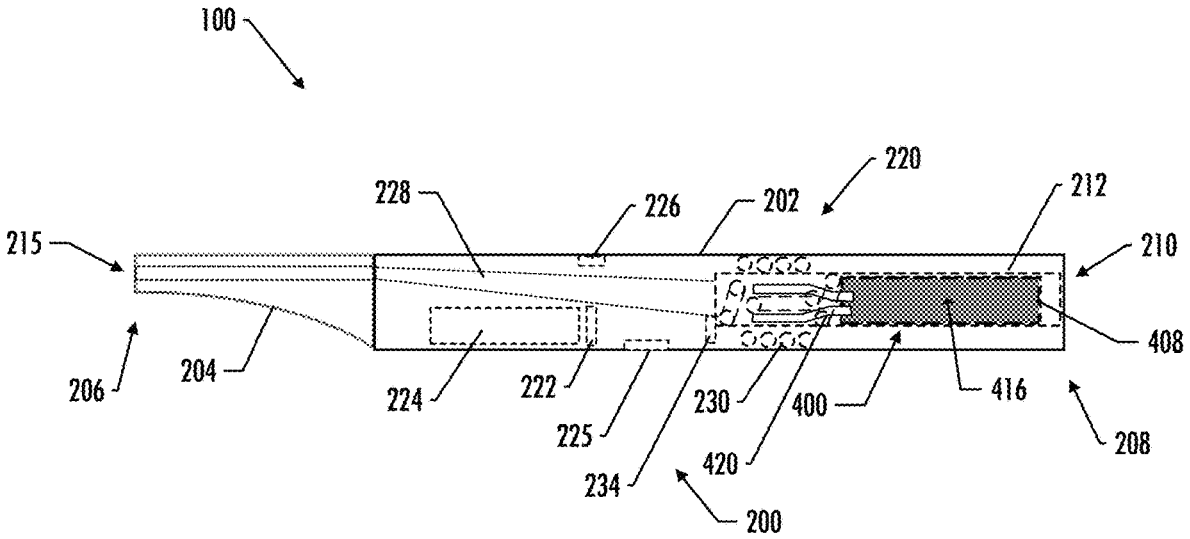
Figure 6:
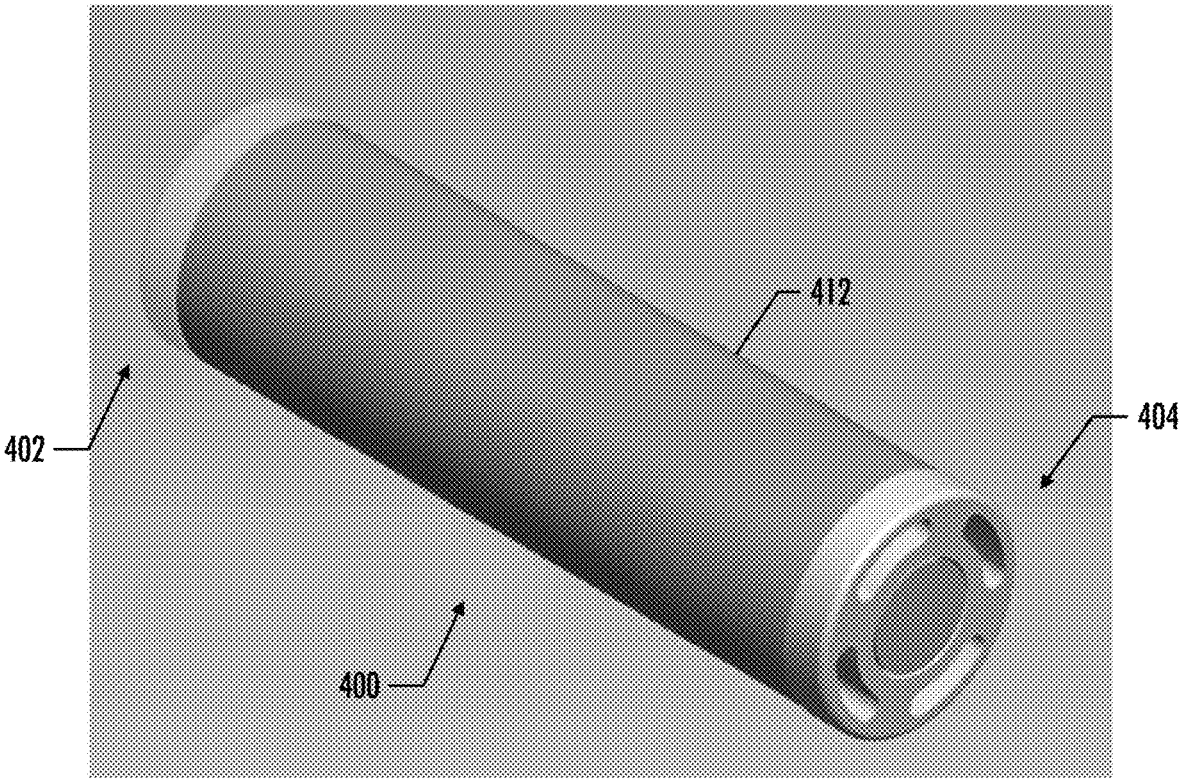
Figure 7A:
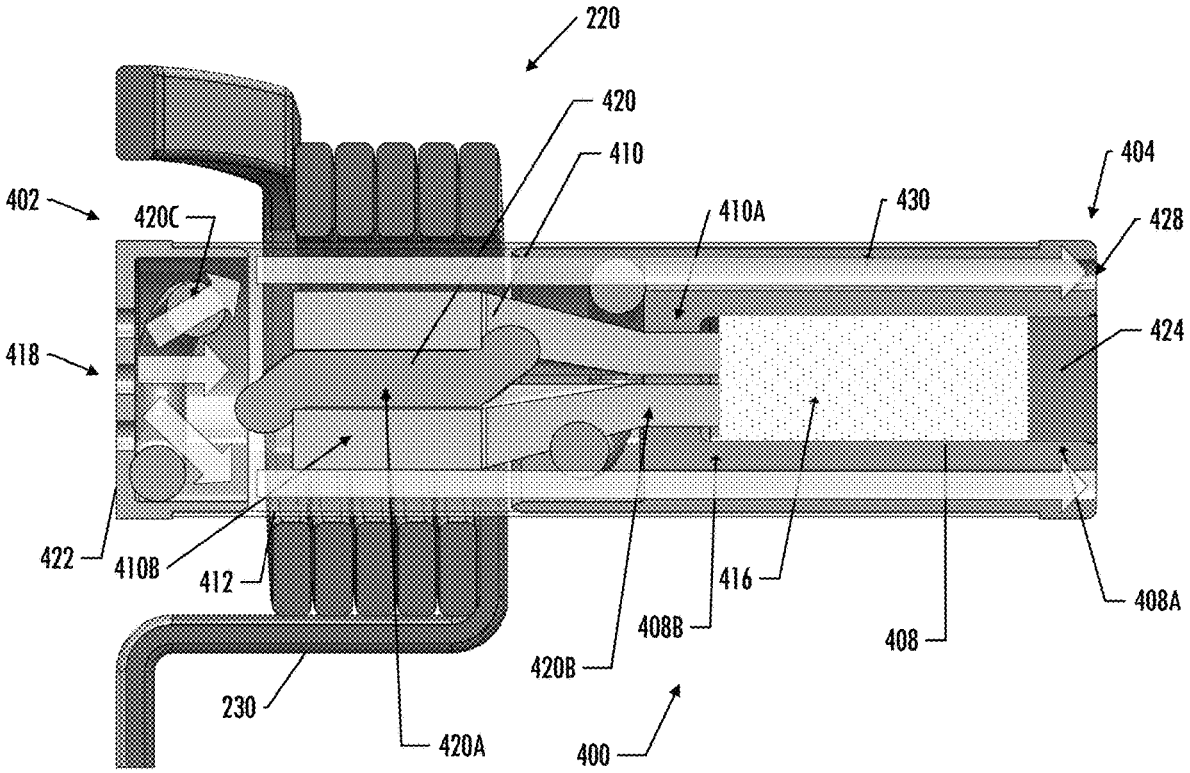
Figure 7B:
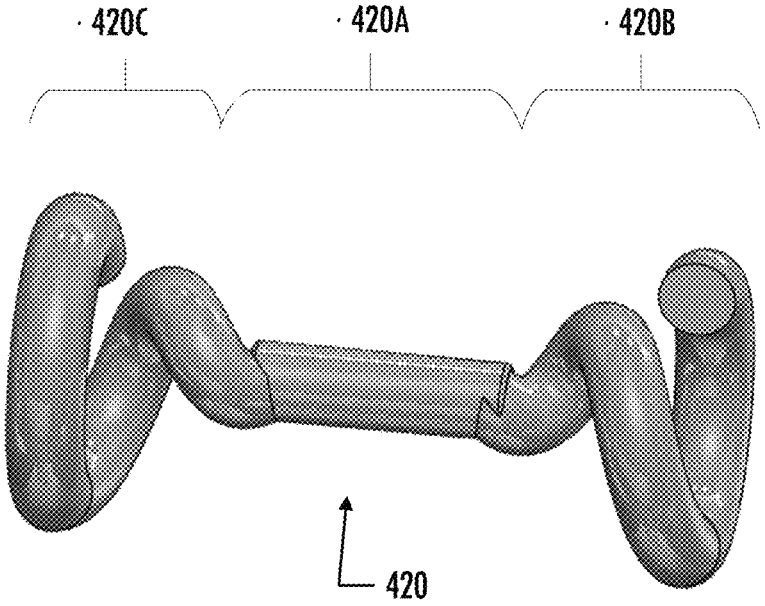
Figure 7C:
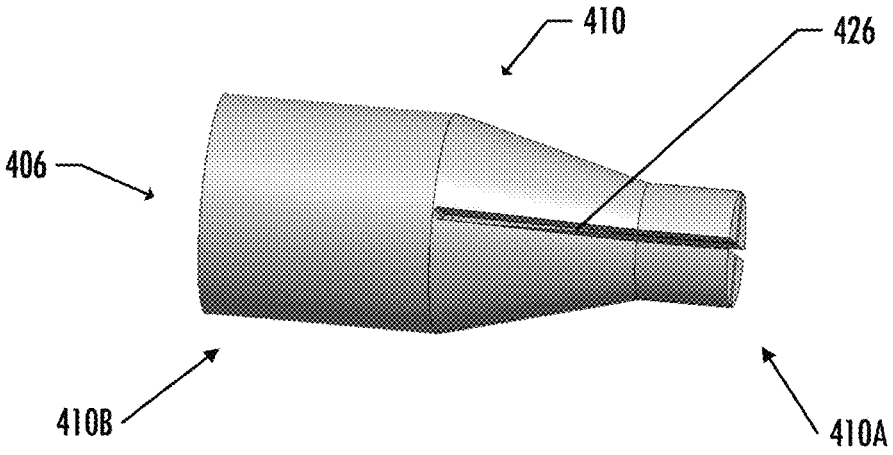
Figure 7D:
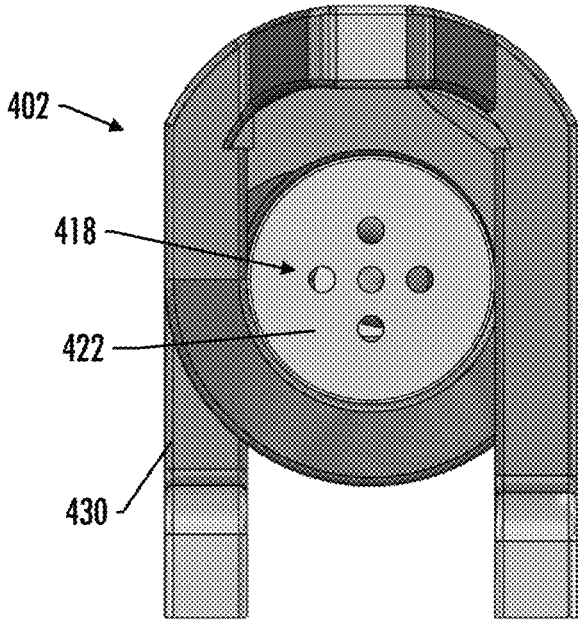
Figure 7E:
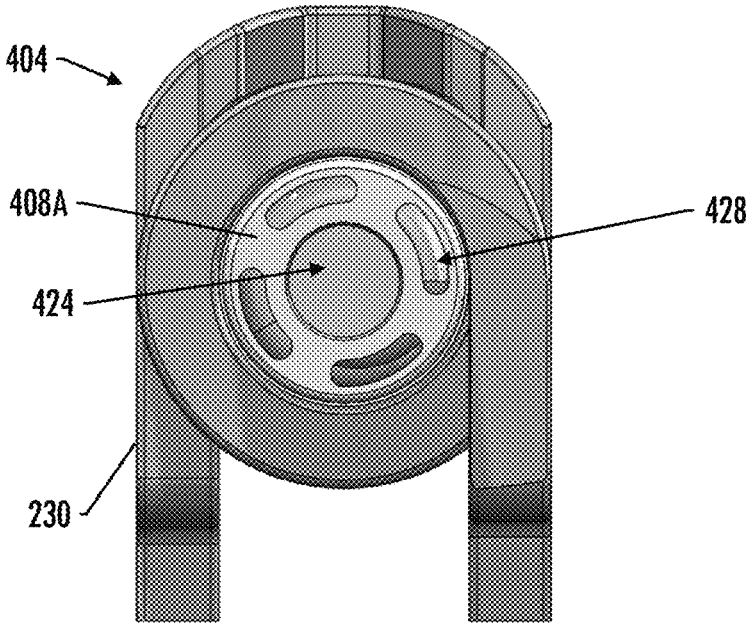
Figure 8A:
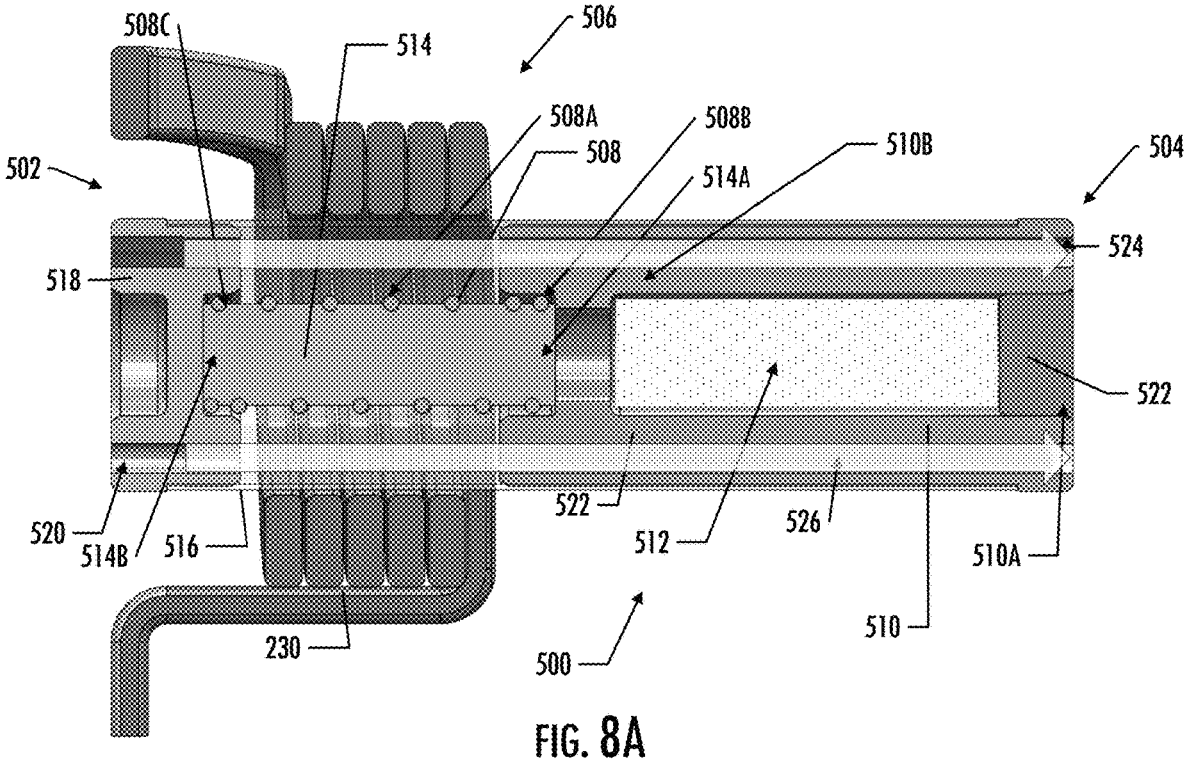
Figure 8B:
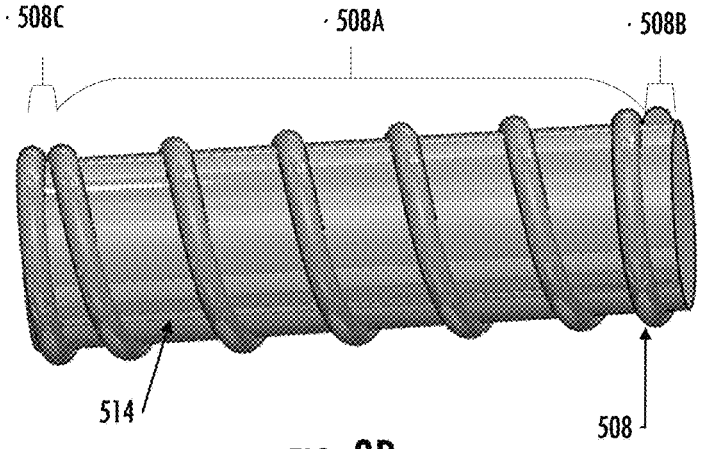
Figure 8C:
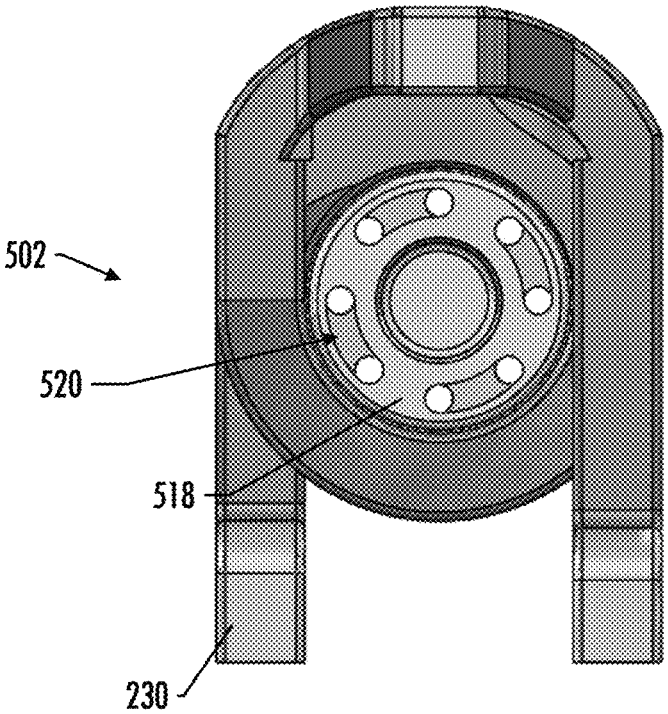
Figure 8D:
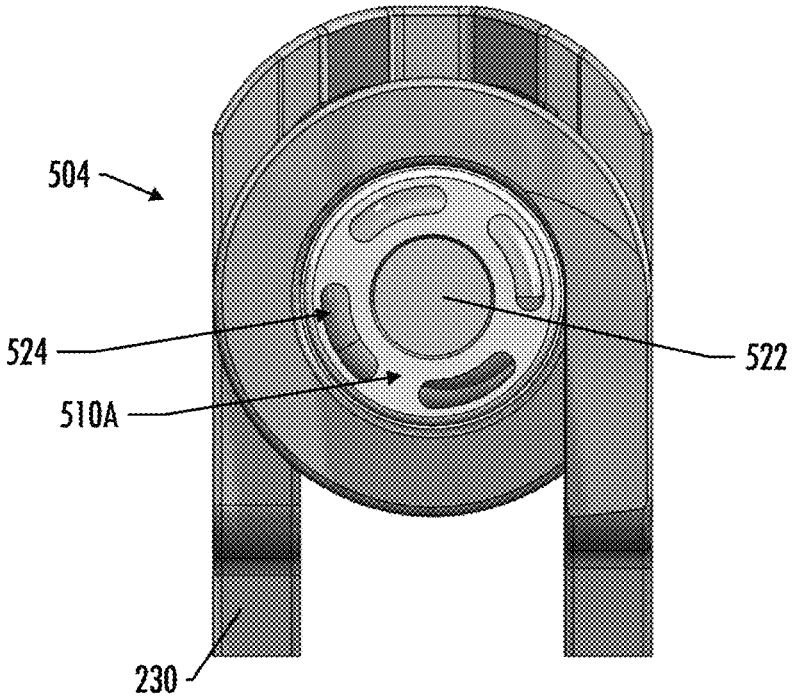

Having thus described the disclosure in the foregoing general terms, reference will now be made to the accompanying drawings, which are not necessarily drawn to scale, and wherein:

FIG. 1 illustrates perspective view of an aerosol delivery device comprising a holder and a removable cartridge, according to one implementation of the present disclosure;

FIG. 2 illustrates a reverse perspective view of an aerosol delivery device comprising a holder and a removable cartridge, according to one implementation of the present disclosure;

FIG. 3 illustrates a reverse perspective view of an aerosol delivery device comprising a holder and a removable cartridge, according to one implementation of the present disclosure;

FIG. 4 illustrates a reverse perspective view of an aerosol delivery device comprising a holder and removable cartridge, according to one implementation of the present disclosure;

FIG. 5 illustrates a longitudinal cross-section view of an aerosol delivery device comprising a holder and a removable cartridge, according to one implementation of the present disclosure;

FIG. 6 illustrates a perspective view of a removable cartridge, according to one implementation of the present disclosure;

FIG. 7A illustrates a longitudinal cross-section view of a removable cartridge and a resonant transmitter of an aerosol delivery device, according to one implementation of the present disclosure;

FIG. 7B illustrates a perspective view of a susceptor of FIG. 7A;

FIG. 7C illustrates a perspective view of the liquid transport element of the removable cartridge of FIG. 7A;

FIG. 7D illustrates a planar view of a distal end of the removable cartridge of FIG. 7A;

FIG. 7E illustrates a planar view of a proximal end of the removable cartridge of FIG. 7A;

FIG. 8A illustrates a longitudinal cross-section view of a removable cartridge of an aerosol delivery device, according to one implementation of the present disclosure;

FIG. 8B illustrates a perspective view of a susceptor and a liquid transport element of the removable cartridge of FIG. 8A;

FIG. 8C illustrates a planar view of a distal end of the removable cartridge of FIG. 8A; and FIG. 8D illustrates a planar view of a proximal end of the removable cartridge of FIG. 8A.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure is embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles (and the assembly and/or manufacture thereof) in which an aerosol precursor composition is heated (preferably without combusting the material to any significant degree) to form an aerosol and/or an inhalable substance; such articles most preferably being sufficiently compact to be considered "hand-held" devices. In some aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In some aspects, articles or devices characterized as smoking articles incorporate tobacco and/or components derived from tobacco.

As noted, aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that device much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "electronic cigarettes," it should be understood that the mechanisms, components, features, and methods may be embodied in many different forms and associated with a variety of articles. For example, the description provided herein may be employed in conjunction with implementations of tobacco heating products, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Aerosol delivery devices of the present disclosure generally include a number of components provided within an outer body or shell, which may be referred to as a housing. The overall design of the outer body or shell can vary, and the format or configuration of the outer body that can define the overall size and shape of the aerosol delivery device can vary. In some example implementations, an elongated body resembling the shape of a cigarette or cigar can be formed from a single, unitary housing or the elongated housing can be formed of two or more separable bodies. For example, an aerosol delivery device can comprise an elongated shell or body that can be substantially tubular in shape and, as such, resemble the shape of a conventional cigarette or cigar. In another example, an aerosol delivery device may be substantially rectangular or have a substantially rectangular cuboid shape. In one example, all of the components of the aerosol delivery device are contained within one housing. Alternatively, an aerosol delivery device can comprise two or more housings that are joined and are separable. For example, an aerosol delivery device can possess one portion comprising a housing containing one or more reusable components (e.g., an accumulator such as a rechargeable battery and/or rechargeable supercapacitor, and various electronics for controlling the operation of that article), and removably coupleable thereto, another second portion (e.g., a mouthpiece) and/or a disposable component (e.g., a disposable flavor-containing cartridge containing aerosol precursor material, flavorant, etc.). More specific formats, configurations and arrangements of components within the single housing type of unit or within a multi-piece separable housing type of unit will be evident in light of the further disclosure provided herein. Additionally, various aerosol delivery device designs and component arrangements can be appreciated upon consideration of the commercially available electronic aerosol delivery devices.

As will be discussed in more detail below, holders of aerosol delivery devices of the present disclosure may comprise some combination of a power source (e.g., an electrical power source), at least one control component (e.g., means for actuating, controlling, regulating and ceasing power, such as by controlling electrical current flow from the power source to other components of the article—e.g., a microprocessor, individually or as part of a microcontroller, a printed circuit board (PCB) that includes a microprocessor and/or microcontroller, etc.), an atomizer portion configured to aerosolize an aerosol precursor composition of a cartridge, and a receiving chamber. Such holders may be configured to accept one or more cartridges that include an aerosol precursor composition capable of yielding an aerosol upon application of sufficient heat. In some implementations, the holder may include a mouthpiece portion configured to allow drawing upon the holder for aerosol inhalation (e.g., a defined airflow path through the holder such that aerosol generated can be withdrawn therefrom upon draw).

In various aspects, the aerosol precursor composition may be aerosolized to form an aerosol. The aerosol precursor composition may comprise tobacco products or a composite of tobacco with other materials. Other implementations may use non-tobacco products. Accordingly, the aerosol precursor composition can vary, and mixtures of various aerosol precursor compositions can be used.

According to certain aspects of the present disclosure, it may be advantageous to provide an aerosol delivery device that is easy to use and that provides reusable and/or replaceable components. FIG. 1 illustrates one example implementation of such a device. In particular, FIG. 1 illustrates a perspective view of an aerosol delivery device 100 that includes a holder 200 and a removable cartridge 300, according to one implementation of the present disclosure. As shown in the figure, the holder 200 comprises a main body 202 defining a receiving chamber 212 (see FIG. 5) configured to receive the removable cartridge 300. In the depicted implementation, the holder 200 comprises the main body 202 and a mouthpiece portion 204, wherein the main body 202 defines a proximal end 206 and a distal end 208. In the depicted implementation, the mouthpiece portion 204 is located proximate the proximal end 206 of the main body 202, and more particularly, a proximal end of the mouthpiece portion 204 defines the proximal end 206 of the main body 202. In the depicted implementation, the mouthpiece portion 204 is removable from the main body 202; however, in other implementations, the mouthpiece portion may be integral with the main body.

In some implementations, the holder (or any components thereof) may be made of moldable plastic materials such as, for example, polycarbonate, polyethylene, acrylonitrile butadiene styrene (ABS), polyamide (Nylon), polypropylene, or any combinations thereof. In other implementations, the holder may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof. As noted above, the mouthpiece portion of some implementations is separable from the main body, while in other implementations, the mouthpiece portion may be integral with the main body. In any event, the mouthpiece portion and the main body may be made of the same material or different materials. In various implementations comprising a separable mouthpiece portion, the mouthpiece portion may be coupled to the main body in a variety of ways, including, for example, via one or more of a snap-fit, interference fit, screw thread, magnetic, and/or bayonet connection. In other implementations, the mouthpiece portion may be integral with the main body and thus may not be separable.

In the depicted implementation, the holder 200 includes an opening 210 located proximate the distal end 208 and through which the cartridge 300 is received. In the depicted implementation, the opening 210 of the holder 200 leads to a receiving chamber 212 (see FIG. 5) located within the holder 200 and defined by the main body. The holder 200 of the depicted implementation also includes an opening 215 (see FIG. 5) located proximate the proximal end 206 through which aerosol is delivered to a user. The holder 200 of the depicted implementation also includes an indicator 226 (see FIG. 5) configured to provide visual indication of one or more conditions of the device 100. In various implementations, a cartridge may be received by the holder (and in particular, the receiving chamber) into a use position. As will be described in more detail below, in the use position an atomizer may be powered to aerosolize an aerosol precursor composition contained therein for delivery to a user.

FIG. 2 illustrates the holder 200 and cartridge 300 of the aerosol delivery device 100 of FIG. 1, with the cartridge 300 being inserted in the opening 210 of the holder 200, such as to locate the cartridge 300 into a use positon. It should be noted that although in the depicted implementation the cartridge 300 has a substantially cylindrical overall shape, in various other implementations, the cartridge or any of its components, may have a different shape. For example, in some implementations the cartridge (and/or any of its components) may have a substantially rectangular shape, such as a substantially rectangular cuboid shape. In other implementations, the cartridge (and/or any of its components) may have other hand-held shapes. Some examples of cartridge configurations that may be applicable to the present disclosure can be found in U.S. patent application Ser. No. 16/515,637, which is incorporated herein by reference in its entirety.

The holder 200 includes a cartridge retention assembly configured to retain the cartridge in the receiving chamber in the use position. In one example implementation, the cartridge retention assembly comprises a spring-loaded latching mechanism, wherein when the cartridge 300 is pushed into and fully received within the receiving chamber 212, the cartridge 300 is temporarily "locked" in place within the holder 200. In other example implementations, other retaining features may be used. For example, in some implementations one or more retention spheres may form part of a cartridge retention assembly. In other implementations, a cartridge retention assembly may comprise one or more resilient members, such as, for example, one or more O-rings, and/or other retaining features that include one or more resilient features that extend into the receiving chamber in order to engage a portion of the outer surface of the cartridge. In other implementations, an outer housing of the cartridge and/or the receiving chamber may include one or more protrusions and/or spring features and corresponding detent features configured to retain the cartridge in the receiving chamber. In still other implementations, an inner surface of the receiving chamber may have a decreasing diameter (and/or one or more portions having a decreased diameter) that may be configured to retain the cartridge in the receiving chamber. In other implementations, the holder may include actively retractable features (e.g., features that are actively retractable by a user) configured to engage the cartridge to retain it in the receiving chamber. In other implementations, the holder may include one or more wedge features configured to engage and retain the cartridge in the receiving chamber. In still other implementations, one or more other features of the cartridge and/or one or more features of the holder may create a releasable connection between the receiving chamber and the cartridge. For example, in some implementations, the cartridge and the receiving chamber may have a releasable screw-type connection. In still other implementations, the cartridge may be retained in the receiving chamber via magnetic force. For example, in some implementations the outer housing of the cartridge may be made of a ferromagnetic material, and the receiving chamber may include one or more magnets. Combinations of two or more of these retaining features may also be used.

In various implementations, one or more components of a cartridge retention assembly may be made of any material, including for example, but not limited to, metal or plastic materials. For example, some implementations may include one or more components of a cartridge retention assembly that are made of a metal material such as, for example, stainless steel, aluminum, brass, copper, silver, gold, bronze, titanium, various alloys, etc. In some implementations, one or more components of a cartridge retention assembly may be made of a moldable plastic material such as, for example, polycarbonate, polyethylene, acrylonitrile butadiene styrene (ABS), polyamide (Nylon), or polypropylene. In some implementations, one or more components of a cartridge retention assembly may be made of a different material, such as, for example, a different plastic material, a different metal material, a graphite material, a glass material, a ceramic material, a natural material (such as, but not limited to, a wood material), a composite material, or any combinations thereof.

FIG. 3 illustrates the holder 200 and cartridge 300 of the aerosol delivery device 100 of FIG. 1, with the cartridge 300 located in a use position. In the use position of the depicted implementation, the distal end of the cartridge 300 is located proximate the distal end 208 of the holder 200 such that the entire cartridge 300 is located inside of the holder 200. In particular, in the use position of the depicted implementation, the distal end of the cartridge 300 is configured to be substantially aligned with (or, in some implementations, inserted past) the distal end 208 of the holder 200 such that the distal end of the cartridge 300 does not extend beyond the distal end 208 of the holder 200. In the use position of other implementations, however, a cartridge may be received into the holder to varying degrees, and, in some implementations, the distal end of the cartridge may extend beyond (e.g., outside of) the distal end of the holder. In the use position of the depicted implementation, the atomizer aerosolizes the aerosol precursor composition contained in the cartridge 300 for delivery to a user through the holder 200. Although not depicted in the figures, the holder of some implementations may include one or more apertures therein for allowing entrance of ambient air to be directed into the receiving chamber and/or the aerosol passageway (such as, for example, through the cartridge and/or downstream from the cartridge). Thus, when a user draws on the holder (e.g., via the mouthpiece portion thereof), air may be drawn into the receiving chamber and/or the aerosol passageway for inhalation by the user.

In the use position of some implementations, a cartridge may be received into the holder to varying degrees. For example, in the use position of some implementations, less than a half of the length of the cartridge may be located within the holder (e.g., less than 50%, less than 40%, less than 30%, less than 20%, less than 10%, etc.). In the use position of other implementations, approximately half of the length of the cartridge may be received into the holder. In the use position of other implementations, more than a half of the length of the cartridge may be received into the holder (e.g., more than 50%, more than 60%, more than 70%, more than 80%, more than 90%, etc).

In some implementations, the holder may include an ejection mechanism. In such a manner, the ejection mechanism may be configured to eject a cartridge from the holder. In one implementation, the ejection mechanism may comprise a spring-loaded plate and latch mechanism, wherein the spring-loaded plate engages the cartridge, directly or indirectly, such that in the use position, the spring is compressed and is held in place with a latch. The latch may be operatively connected to a user activated button, which is configured to release the latch when activated by the user. FIG. 4 illustrates the holder 200 ejecting the cartridge 300 from the receiving chamber of the holder 200 through the opening 210. In some implementations, the ejection mechanism comprises part of the spring-loaded cartridge retention assembly. In other implementations, however, the ejection mechanism may comprise an independent mechanism. In the depicted implementation, the ejection mechanism is activated via a button 225 located on the holder 200. In other implementations, however, the ejection mechanism may be activated in other ways.

As noted, the holder of an aerosol delivery device of various implementations of the present disclosure includes an atomizer comprising an inductive heater configured to heat at least a portion of the aerosol precursor composition of the cartridge. In various implementations, the holder of the present disclosure may accommodate a removable cartridge that includes aerosol precursor composition in a substantially solid form, such as, for example, a tobacco material (e.g., tobacco beads), and/or a removable cartridge that includes an aerosol precursor composition in a substantially liquid or gel form, such as, for example, the cartridges depicted in FIGS. 5-8D.

FIG. 5 illustrates a schematic view of the holder 200 and a cartridge 400 of an aerosol delivery device of the present disclosure along with an example implementation of an inductive heating assembly 220. Various implementations of the inductive heating assembly 220 are described in more detail in FIGS. 7A-7E and FIGS. 8A-8D. As will be described in more detail below, the inductive heating assembly of various implementations is configured to inductively heat the aerosol precursor composition of the removable cartridge so as to form an aerosol upon application of heat thereto.

The holder 200 of the depicted implementation in FIG. 5 further includes a control component 222 (e.g., a microprocessor, individually or as part of a microcontroller, a printed circuit board (PCB) that includes a microprocessor and/or microcontroller, etc.), a power source 224 (e.g., a battery, which may be rechargeable, and/or a rechargeable supercapacitor), a manually actuatable button 225, an indicator 226 (e.g., a light emitting diode (LED)), and an aerosol passage 228 that extends from the receiving chamber 212, through the main body 202, and out through the opening 215 in the mouthpiece portion 204.

In some implementations, the holder may be characterized as being disposable in that the holder may be configured for only a limited number of uses (e.g., until a battery power component no longer provides sufficient power to the article) with a limited number of cartridges and, thereafter, the entire device, including the holder, may be discarded. In other implementations, the holder may have a replaceable power source (e.g., a replaceable battery) such that the holder may be reused through a number of power source exchanges and with many cartridges. Similarly, the holder may be rechargeable and thus may be combined with any type of recharging technology. For example, the holder may have a replaceable battery or a rechargeable battery, solid-state battery, thin-film solid-state battery, rechargeable supercapacitor or the like, and thus may be combined with any type of recharging technology, including connection to a wall charger, connection to a car charger (i.e., cigarette lighter receptacle), and connection to a computer, such as through a universal serial bus (USB) cable or connector (e.g., USB 2.0, 3.0, 3.1, USB Type-C), connection to a photovoltaic cell (sometimes referred to as a solar cell) or solar panel of solar cells, a wireless charger, such as a charger that uses inductive wireless charging (including for example, wireless charging according to the Qi wireless charging standard from the Wireless Power Consortium (WPC)), or a wireless radio frequency (RF) based charger. An example of an inductive wireless charging system is described in U.S. Pat. App. Pub. No. 2017/0112196 to Sur et al., which is incorporated herein by reference in its entirety. Further, in some implementations, the mouthpiece portion may comprise a single-use device. A single use component for use with a control body is disclosed in U.S. Pat. No. 8,910,639 to Chang et al., which is incorporated herein by reference in its entirety. In some implementations, the holder may be inserted into and/or coupled with a separate charging station for charging a rechargeable battery of the device. In some implementations, the charging station itself may include a rechargeable power source that recharges the rechargeable battery of the device.

Some additional examples of possible power sources are described in U.S. Pat. No. 9,484,155 to Peckerar et al., and U.S. Pat. App. Pub. No. 2017/0112191 to Sur et al., the disclosures of which are incorporated herein by reference in their respective entireties. Reference also is made to the control schemes described in U.S. Pat. No. 9,423,152 to Ampolini et al., which is incorporated herein by reference in its entirety. In one implementation, the indicator 226 may comprise one or more light emitting diodes, quantum dot-based light emitting diodes or the like. The indicator 226 can be in communication with the control component 222 and be illuminated, for example, when the lighter portion is active and/or when a cartridge is received in the receiving chamber 212 of the housing 200.

As noted, one function of the inductive heating assembly 220 of the depicted implementation in FIG. 5 is to heat at least a portion of the aerosol precursor composition 416, which is configured to form an aerosol upon application of heat thereto. A reservoir 408 may contain at least a portion of the aerosol precursor composition 416. The reservoir 408 may be formed of any suitable material including a moldable plastic material such as, for example, polycarbonate, polyethylene, acrylonitrile butadiene styrene (ABS), polyamide (Nylon), or polypropylene. In other implementations, the reservoir 408 may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof. Notably, if a metal material is used for the reservoir 408, the metal may not cover any susceptor materials associated with the inductive heating assembly or reside within the induction coil 230, as the metal could heat or block energy intended for the susceptor materials.

In various implementations, the inductive heating assembly may comprise a resonant transmitter located proximate at least a portion of the receiving chamber and configured to interact with at least one resonant receiver (e.g., one or more susceptor materials). In such a manner, the aerosol precursor composition in a cartridge of the present disclosure may be heated, by directing alternating current to the at least one resonant transmitter to produce an oscillating magnetic field in order to induce eddy currents in the at least one resonant receiver. In some implementations, a combination of resonant receivers may be configured to heat the aerosol precursor composition.

In the depicted implementation, the aerosol precursor composition 416 is heated by the resonant receiver. For example, the resonant receiver may comprise a susceptor. Alternating current in the susceptor will generate heat to aerosolize the aerosol precursor composition 416 contained in the cartridge. As noted above, it should be noted that in other implementations various other configurations are possible. In another implementation, the cartridge may include a layer of susceptor material substantially surrounding the aerosol precursor composition in the reservoir 408. Examples of various inductive heating methods and configurations are described in U.S. Pat. App. Pub. No. 2019/0124979 to Sebastian et al., which is incorporated by reference herein in its entirety. Further examples of various induction-based control components and associated circuits are described in U.S. Pat. App. Pub. No. 2018/0132531 to Sur et al., and U.S. Patent App. Pub. No. 2017/0202266 to Sur et al., each of which is incorporated herein by reference in its entirety.

Although in various implementations the resonant transmitter may have a variety of forms, in the depicted implementation the resonant transmitter comprises an induction coil 230 (such as, but not limited to, a helical coil having any number of turns) that extends at least a portion of the length of the receiving chamber 212. In various implementations, the resonant transmitter may be made of one or more conductive materials, including, for example, silver, gold, aluminum, brass, zinc, iron, nickel, and alloys of thereof, conductive ceramics e.g., yttrium-doped zirconia, indium tin oxide, yttrium doped titanate, etc, and any combination of the above. In the depicted implementation, the induction coil 230 is made of a conductive metal material, such as copper. In further implementations, the induction coil may include a nonconductive insulating cover/wrap material. Such materials may include, for example, one or more polymeric materials, such as epoxy, silicon rubber, etc., which may be helpful for low temperature applications, or fiberglass, ceramics, refractory materials, etc., which may be helpful for high temperature applications.

It should be noted that although the depicted implementation describes a single resonant transmitter, in other implementations, there may be multiple independent resonant transmitters, including, for example, implementations having segmented inductive heating arrangements. In such a manner, for example, the inductive heater portion may comprise a first portion and a second portion.

As noted, a change in current in the resonant transmitter (e.g., an induction coil), as directed thereto from the power source by the control component (e.g., via a driver circuit) may produce an alternating electromagnetic field that penetrates the susceptor(s), thereby generating electrical eddy currents within the susceptor(s). In some implementations, the alternating electromagnetic field may be produced by directing alternating current to the resonant transmitter. In some implementations, the control component may include an inverter or inverter circuit configured to transform direct current provided by the power source to alternating current that is provided to the resonant transmitter.

The eddy currents flowing in the susceptor(s) may generate heat through the Joule effect, wherein the amount of heat produced is proportional to the square of the electrical current times the electrical resistance of the susceptor. For implementations wherein the susceptor comprises ferromagnetic materials, heat may also be generated by magnetic hysteresis losses. Several factors may contribute to the temperature rise of the susceptor including, but not limited to, proximity to the resonant transmitter, distribution of the magnetic field, electrical resistivity of the material of the susceptor component, saturation flux density, skin effects or depth, hysteresis losses, magnetic susceptibility, magnetic permeability, and dipole moment of the material of the susceptor.

In the depicted implementation, the induction coil 230 and the main body 202 define the receiving chamber 212. In other implementations, however, the receiving chamber 212 may be defined by one or more other features, such as, for example, a support cylinder, a portion of which may be located within the induction coil 230. In still other implementations, the receiving chamber may be defined by other features and may have other forms. For example, in some implementations, the receiving chamber may comprise a rotatable door, a siding tray, etc. In various implementations, the shape of the receiving chamber may be configured to accommodate one or more different cross-sectional shapes of a cartridge. For example, in some implementations in which the cartridge has a substantially round cross-sectional shape, the receiving chamber may have a substantially cylindrical shape, etc.

In the depicted implementation, the resonant transmitter 230 substantially surrounds an inner diameter of a portion of the receiving chamber 212, which is configured to receive the cartridge 400. In the depicted implementation, the induction coil 230 defines a generally tubular configuration. In other implementations, a support cylinder may also define a tubular configuration and may be configured to support the induction coil 230 such that the induction coil 230 does not contact the cartridge, but simply surrounds the cartridge with an air gap therebetween. As such, in some implementations, the support cylinder may comprise a nonconductive material, which may be substantially transparent to an oscillating magnetic field produced by the induction coil 230. In various implementations, the induction coil 230 may be imbedded in, or otherwise coupled to, a support cylinder 232.

As noted above, in various implementations an inductive heating assembly may include at least one resonant receiver configured to heat at least a portion of the aerosol precursor composition thereof. As shown, for example in FIG. 5, and then in more detail in FIGS. 7A-7E, one example implementation of an inductive heating assembly is shown, where the resonant receiver is a susceptor having an active portion around which at least one end of a liquid transport element extends. In this example implementation, at least the active portion of the susceptor is arranged to heat a second end of a liquid transport element and thereby heat the aerosol precursor composition therein to form the aerosol.

The liquid transport element can be formed of a substrate material that is preferably thermally and mechanically stable under the conditions of use and is configured to transport a fluid (e.g., through capillary action). For example, the liquid transport element may be formed of a material that is temperature stable at a temperature of about 100° C. or greater, about 150° C. or greater, about 200° C. or greater, about 300° C. or greater, about 400° C. or greater, or about 500° C. or greater. In other embodiments, the liquid transport element can be temperature stable in a temperature range of about 100° C. to about 750° C., about 125° C. to about to about 650° C., or about 150° C. to about 500° C. Non-limiting examples include natural and synthetic fibers, such as cotton, cellulose, polyesters, polyamides, polylactic acids, glass fibers, combinations thereof, and the like. In some embodiments a fiberglass cord may comprise a plurality of fiberglass filaments defining a diameter from about 9 microns to about 10 microns. The filaments may be twisted and/or woven together in any of a variety of patterns to form the fiberglass cord. The overall diameter of the fiberglass cord may be from about 1 millimeter to about 2 millimeters. However, various other embodiments of materials and sizes thereof may be employed in other embodiments.

In some other example embodiments, the liquid transport element may be nonfibrous, meaning the liquid transport element is formed from a solid material having a microtextured surface rather than a surface formed by a plurality of bundled fibers. As notes herein, "microtextured" refers to a surface having topographical three-dimensional features at the micro-meter scale (e.g., a plurality of three-dimensional surface features having an average height of less than about 250 microns) that are discontinuous in appearance such that the surface includes multiple concave and convex portions. Non-limiting examples include a ceramic material, particularly a silicon-based material, such as a silicon nitride or silicon dioxide material. Other materials, however, such as glass or quartz can be used. Certain thermoplastic materials, such as cyclic olefin copolymers (COC), also can be used.

In various implementations, the inductive heating assembly may be configured to heat the aerosol precursor composition for a period of time. In the depicted implementation, the inductive heating assembly 220 is activated automatically when the cartridge 400 is received in the receiving chamber 212. This may be accomplished, for example, via a sensor 234 configured to send a signal to the control component 222 upon sensing that the cartridge 300 is fully received in the receiving chamber 212. In other implementations, however, other methods of determining the presence of the cartridge may be used, and a cartridge need not be fully received in the receiving chamber in order to activate the inductive heating assembly. In still other implementations, activation of the inductive heating assembly may occur manually. For example, in some implementations activation of the inductive heating assembly may occur via actuation of an input element, such as, for example, a button.

In some implementations, other input elements may be included (which may replace or supplement a cartridge sensor, and/or a manually actuated button configured to activate the lighter portion). Any component or combination of components may be utilized as an input for controlling the function of the device. For example, one or more pushbuttons may be used as described in U.S. Pub. No. 2015/0245658 to Worm et al., which is incorporated herein by reference in its entirety. Likewise, a touchscreen may be used as described in U.S. Pat. App. Pub. No. 2016/0262454, to Sears et al., which is incorporated herein by reference in its entirety. As a further example, components adapted for gesture recognition based on specified movements of the aerosol delivery device may be used as an input. See U.S. Pat. App. Pub. No. 2016/0158782 to Henry et al., which is incorporated herein by reference in its entirety. As still a further example, a capacitive sensor may be implemented on the aerosol delivery device to enable a user to provide input, such as by touching a surface of the device on which the capacitive sensor is implemented.

Still further components can be utilized in the aerosol delivery device of the present disclosure. For example, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth-end of a device to detect user lip activity associated with taking a draw and then trigger heating of a heating device; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and PCT Pat. App. Pub. No. WO 2010/003480 by Flick discloses a fluid flow sensing system indicative of a puff in an aerosol generating system; all of the foregoing disclosures being incorporated herein by reference in their entireties.

Other suitable current actuation/deactuation mechanisms may include a temperature actuated on/off switch or a lip pressure actuated switch, or a touch sensor (e.g., capacitive touch sensor) configured to sense contact between a user (e.g., mouth or fingers of user) and one or more surfaces of the aerosol delivery device. An example mechanism that can provide such puff-actuation capability includes a Model 163PC01D36 silicon sensor, manufactured by the Micro-Switch division of Honeywell, Inc., Freeport, Ill. With such sensor, the atomizer may be activated rapidly by a change in pressure when the user draws on the device. In addition, flow sensing devices, such as those using hot-wire anemometry principles, may be used to cause the energizing of the heating assembly sufficiently rapidly after sensing a change in airflow. A further puff actuated switch that may be used is a pressure differential switch, such as Model No. MPL-502-V, range A, from Micro Pneumatic Logic, Inc., Ft. Lauderdale, Fla. Another suitable puff actuated mechanism is a sensitive pressure transducer (e.g., equipped with an amplifier or gain stage) which is in turn coupled with a comparator for detecting a predetermined threshold pressure. Yet another suitable puff actuated mechanism is a vane which is deflected by airflow, the motion of which vane is detected by a movement sensing means. Yet another suitable actuation mechanism is a piezoelectric switch. Also useful is a suitably connected Honeywell MicroSwitch Microbridge Airflow Sensor, Part No. AWM 2100V from MicroSwitch Division of Honeywell, Inc., Freeport, Ill. Further examples of demand-operated electrical switches that may be employed in a circuit according to the present disclosure are described in U.S. Pat. No. 4,735,217 to Gerth et al., which is incorporated herein by reference in its entirety. Other suitable differential switches, analog pressure sensors, flow rate sensors, or the like, will be apparent to the skilled artisan with the knowledge of the present disclosure. In some implementations, a pressure-sensing tube or other passage providing fluid connection between the puff actuated switch and substrate tablet may be included in the housing so that pressure changes during draw are readily identified by the switch. Other example puff actuation devices that may be useful according to the present disclosure are disclosed in U.S. Pat. Nos. 4,922,901, 4,947,874, and 4,947,874, all to Brooks et al., U.S. Pat. No. 5,372,148 to McCafferty et al., U.S. Pat. No. 6,040,560 to Fleischhauer et al., U.S. Pat. No. 7,040,314 to Nguyen et al., and U.S. Pat. No. 8,205,622 to Pan, all of which are incorporated herein by reference in their entireties.

Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. No. 8,794,231 to Thorens et al.; U.S. Pat. No. 8,851,083 to Oglesby et al.; U.S. Pat. Nos. 8,915,254 and 8,925,555 to Monsees et al.; U.S. Pat. No. 9,220,302 to DePiano et al.; U.S. Pat. App. Pub. Nos. 2006/0196518 and 2009/0188490 to Hon; U.S. Pat. App. Pub. No. 2010/0024834 to Oglesby et al.; U.S. Pat. App. Pub. No. 2010/0307518 to Wang; PCT Pat. App. Pub. No. WO 2010/091593 to Hon; and PCT Pat. App. Pub. No. WO 2013/089551 to Foo, each of which is incorporated herein by reference in its entirety. Further, U.S. Pat. App. Pub. No. 2017/0099877 discloses capsules that may be included in aerosol delivery devices and fob-shape configurations for aerosol delivery devices, and is incorporated herein by reference in its entirety. A variety of the materials disclosed by the foregoing documents may be incorporated into the present devices in various implementations, and all of the foregoing disclosures are incorporated herein by reference in their entireties.

FIG. 6 describes an example implementation of the external structure of a cartridge, such as the cartridge 400 of the implementation described in FIGS. 5 and 7A-7E. The cartridge of FIG. 6 may also describe the external structure of the cartridge 400 described in FIGS. 8A-8D, though it may differ. In this example implementation, the cartridge 400 may comprise a proximal end 402 and a distal end 404 and an outer housing 412 extending therebetween. As shown in FIG. 6, the cartridge may be formed with a substantially cylindrical cross-section that corresponds to a cross-section of the receiving chamber 212 of the holder 200, though the cartridge may have a cross-section that differs from that of the receiving chamber 212. As such, the outer housing 412 may be of any size or shape, such as cylindrical, quadrilateral, and the like. The outer housing 412 may extend substantially an entirety of a length of the cartridge, such that the outer housing 412 (and thereby the cartridge 400) is about 20-35 mm in length; and in particular, 25-30 mm in length. A diameter of the outer housing 412 may be between about 5-15 mm in diameter; and in particular, 7-7.5 mm in diameter. Although dimensions and cross-section shapes of the various components (e.g., the outer housing) of the cartridge may vary due to the needs of a particular application, in the depicted implementations the cartridge may have an overall length in an inclusive range of approximately 10 mm to approximately 50 mm and a diameter in an inclusive range of approximately 2 mm to approximately 20 mm. In addition, in the depicted implementations, the outer housing may have a thickness in the inclusive range of approximately 0.05 mm to 0.5 mm.

The outer housing 412 may be formed of any suitable material including a moldable plastic material such as, for example, polycarbonate, polyethylene, acrylonitrile butadiene styrene (ABS), polyamide (Nylon), or polypropylene. In other implementations, the outer housing 412 may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof.

Referring back to FIG. 5, and shown in more detail in FIGS. 7A-7E, one example implementation of an atomizer in the form of an inductive heating assembly is illustrated. The inductive heating assembly 220 of FIG. 5 comprises a resonant receiver in the form of a susceptor 420 and a resonant transmitter 230 in the form of an inductive coil. The reservoir or reservoir chamber 408 contains the aerosol precursor composition 416 configured to form the aerosol upon application of heat thereto. The reservoir 408 may define two opposing ends. A first open end of the reservoir 408A is arranged toward the distal end 404 of the cartridge 400 and an opposing second open end of the reservoir 408B is arranged toward the proximal end 402 of the cartridge 400. A liquid transport element 410 having a first end 410A in fluid communication with the reservoir 408 so as to transport the aerosol precursor composition 416 from the reservoir 408 and into an opposing second end 410B of the liquid transport element 410 is also shown. The first end 410A of the liquid transport element 410 may extend into the second open end 408B of the reservoir, so as to act as a wick. In this manner, the liquid transport element 410 may be, for example, in the form of a fiberglass sheathing that is pliable and may be deformable so as to be inserted into the reservoir 408.

The susceptor 420 may be arranged and configured to be heated by the resonant transmitter 230. In some implementations, the susceptor 420 may comprise a ferromagnetic material including, but not limited to, cobalt, iron, nickel, zinc, manganese, and any combinations thereof. In some implementations, one or more components of the susceptor may be made of other materials, including, for example, other metal materials such as aluminum or magnetic stainless steel (e.g., 400 series stainless steels such as, 410, 430, 440C), as well as ceramic materials such as silicon carbide, and any combinations of any of the materials described herein. In still other implementations, the susceptor may comprise other conductive materials including metals such as copper, alloys of conductive materials, or other materials with one or more conductive materials imbedded therein. In some implementations, the susceptor 420 may comprise a granulated susceptor component, including, but not limited to a shredded susceptor material. In other implementations, a granulated susceptor component may comprise susceptor particles, susceptor beads, etc.

In some example implementations, the susceptor 420 comprises an active portion 420A around which at least the second end 410B of the liquid transport element 410 extends. At least the active portion 420A of the susceptor 420 may be arranged to heat the second end 410B of the liquid transport element 410 and thereby heat the aerosol precursor composition 416 therein to form the aerosol. Opposing ends 420B, 420C of the susceptor 420 circumferentially and axially position the active portion 420A of the susceptor 420 within the cartridge 400 and relative to the liquid transport element 410, and/or an outer housing 412 and the reservoir 408.

As used herein, "circumferentially position" refers to an arrangement of the susceptor 420 relative to an inner circumference of the outer housing 412, while "axially position" refers to an arrangement of the susceptor 420 relative to a longitudinal length of the cartridge 400. Positioning or arranging the susceptor 420 circumferentially or axially may permanently position the susceptor relative to the liquid transport element 410, and/or an outer housing 412 and the reservoir 408, or may removably position it, such that the susceptor 420 may be repositioned or removed. Movement of the cartridge 400 and/or aerosol delivery device during the ordinary course of use should not change the position of the susceptor 420, such that the susceptor 420 is sufficiently retained in position unless intentionally repositioned.

In order to aid in the circumferential and axial positioning of the susceptor 420, the opposing ends 420B, 420C of the susceptor 420 are considered to be circumferentially turned ends with the active portion 420A longitudinally-extending therebetween. As shown in FIG. 8B, the circumferentially turned ends 420B, 420C curve in opposing directions from the active portion 420A. In particular, a first one of the circumferentially turned ends 420B, extends curvilinearly outwardly from the active portion 420A in a counter clockwise direction and completes substantially a full turn (about 360 degrees) with its curve. By comparison, a second one of the circumferentially turned ends 420C, extends curvilinearly outwardly from the active portion 420A in a clockwise direction and completes substantially a full turn (about 360 degrees) with its curve. Optionally, the two circumferentially turned ends 420B, 420C may curve in the same direction (e.g., clockwise or counterclockwise), or may rectilinearly (rather than curvilinearly) extend from the active portion 420A.

Regarding the number of turns of the circumferentially turned ends 420B, 420C, one or both of the circumferentially turned ends 420B, 420C may complete more than one turn or partial turns, such that either one or both of the ends 420B, 420C completes a turn and a half (about 540 degrees), two turns (about 720 degrees), etc. Further still, either one or both of the ends 420B, 420C may not complete a full turn and may extend curvilinearly less than about 360 degrees. The circumferentially turned ends 420B, 420C may be integrally formed with the active portion 420A, or may be removably attached/coupled to the active portion. For example, the circumferentially turned ends 420B, 420C and active portion 420A are integrally formed via cold forming with a multi-piece forming fixture (or in some implementations hot winding) the turned ends.

With regard to the liquid transport element 410, and as shown in FIG. 7C, for example, the liquid transport element 410 may be formed as a substantially cylindrical sheath defining an end opening 406 through which at least a portion of the susceptor 420 extends. In this example implementation, the second turned end 420C of the susceptor 420 extends through the end opening 406 in the liquid transport element 410 and proximate to the second end 410B of the liquid transport element 410, while the second end 410B of the liquid transport element substantially circumscribes the active portion 420A of the susceptor 420 (see FIG. 7A). In the depicted implementation, the first end 410A of the liquid transport element 410 defines at least one opening 426 extending from the first end 410A of the liquid transport element 410 and at least partially along a longitudinal length (longest dimension of the susceptor 420) thereof. Thus, the first circumferentially turned end 420B of the susceptor 420 extends through the at least one opening 426 such that the first end 410A of the liquid transport element 410 extends through a center of the first circumferentially turned end 420B of the susceptor 420, while the second end 410B of the liquid transport element 410 is wrapped around the active portion 420A of the susceptor 420 and the second circumferentially turned end 420C of the susceptor 420 extends out of the end opening 406 and proximate to the second end 410B of the liquid transport element 410. While in the depicted implementation the at least one opening 426 extends from the first end of the liquid transport element and at least partially along a longitudinal length thereof (such as, for example, a slit substantially aligned with a longitudinal axis of the liquid transport element 410), in other implementations the opening 426 need not be so aligned, and, in still other implementations, the opening 426 may have any form or location wherein a portion of the susceptor extends therethrough (such as, for example, a discrete opening located on a portion of the liquid transport element and through which the susceptor extends).

In some other implementations, the liquid transport element 410 may be another material other than fiberglass, such as, for example, cotton, ceramic, and the like. The liquid transport element 410 may also have another shape or form. For example, the liquid transport element 410 may be a strip of material that is wrapped around the active portion 420A of the susceptor 420 and then positioned in fluid communication with the reservoir 408.

The resonant transmitter 230, which may be located proximate at least a portion of a receiving chamber (e.g., receiving chamber 212 in FIG. 5) may substantially surround at least the active portion 420A of the susceptor 420. For example, where the resonant transmitter 230 is in the form of an inductive coil, the coils thereof may encircle at least the active portion 420A of the susceptor 420. Thus, the aerosol precursor composition 416 is transported through the liquid transport element 420 (e.g., by capillary action) from the first end 410A to the second end 410B, and heated by the active portion 420A of the susceptor 420 when the active portion 420A of the susceptor 420 is energized by the resonant transmitter 230.

In the depicted implementation, the cartridge 400 includes an outer housing 412 that at least partially circumscribes the reservoir 408, the liquid transport element 410, and the susceptor 420. In the depicted implementation, the outer housing 412 is constructed as a tubular structure that substantially encapsulates the aerosol precursor composition 416; however, as noted above, in other implementations the outer housing may have other shapes. Although the shape of the outer housing may vary, in the depicted implementation the outer housing 412 comprises a tubular structure having opposed closed ends with openings defined therethrough.

In the depicted implementation, and as shown in particular in FIG. 7D, the outer housing 412 of the cartridge 400 includes an end cap 422 defining end apertures 418 and arranged to cover or substantially cover the proximal end 402 of the outer housing/cartridge 400. The end apertures 418 are configured to allow air to pass through and intermingle with the aerosol generated by the inductive heating assembly 220. The end apertures 418 of the depicted implementation are in the form of five circular openings; however, in other implementations the end apertures may have any form that permits passage of the air therethrough. As such, it will be appreciated that the end apertures 418 can comprise fewer or additional apertures and/or alternative shapes and sizes of apertures than those illustrated.

The end cap 422 may be arranged proximate to the second end 420C of the susceptor 420 so that it engages the outer housing 412 and encloses (substantially covers) the second end 420C of the susceptor 420 therein. The end cap 422 may engage the outer housing 412 in a variety of ways, including, for example, via one or more of a snap-fit, interference fit, screw thread, magnetic, and/or bayonet connection. In other implementations, the end cap 422 may be integral with the outer housing 412 and thus may not be separable. The end cap 422 may be formed of any suitable material including a moldable plastic material such as, for example, polycarbonate, polyethylene, acrylonitrile butadiene styrene (ABS), polyamide (Nylon), or polypropylene. In other implementations, the end cap 422 may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof.

Further still, in the depicted implementation, and more particularly shown in FIG. 7E, a plug 424 is arranged relative to the distal end 404 of the outer housing/cartridge 400 so as to cover or substantially cover the first open end 408A of the reservoir 408. The first open end 408A of the reservoir may define a central opening arranged in a central area of the reservoir 408 and in which the plug 424 is arranged. The first open end 408A of the reservoir may also define a plurality of circumferentially extending openings 428 arranged around the central opening. As shown in the depicted implementation, there are four openings 428. The centrally openings 428 may be so formed so as to allow aerosol or vapor pass through the circumferentially extending openings 428 and through, for example, the passageway 228 of the main body 212 of the holder 200 (FIG. 5). The plug 424 may engage the reservoir 408 in a variety of ways, including, for example, via one or more of a snap-fit, interference fit, screw thread, magnetic, and/or bayonet connection. In other implementations, the plug 424 may be integral with the reservoir 408 and thus may not be separable. The plug 424 may be formed of any suitable material including a resilient polymeric material, such as, for example, silicone, or may be a plastic material such as, for example, polycarbonate, polyethylene, acrylonitrile butadiene styrene (ABS), polyamide (Nylon), or polypropylene. In other implementations, the plug 424 may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof.

Although in other implementations the size and shape of the end apertures 418 and the circumferentially extending openings 428 may differ, the circumferentially extending openings 428 of the depicted implementation comprise a plurality of elongate rounded slots circumferentially extending about the central area of the first open end 408A of the reservoir 408, and the end apertures 418 comprise one or more aligned rows and/or columns of substantially circular openings. In the depicted implementation in FIG. 7A, the circumferentially extending openings 428 may be in fluid communication with the end apertures 418 of the end cap 422 via internal passageways 430, which extend between an exterior surface of the reservoir and an interior surface of the outer housing 412. It should be noted that in other implementations, there may be one internal passageway or multiple internal passageways 430 that may take other forms and/or sizes. For example, in some implementations, there may be one internal passageway, two external passageways, three external passageways, four external passageways, and the like. Still other implementations may include no internal passageways at all. Additional implementations may include multiple internal passageways that may be of unequal diameter and/or shape and which may be unequally spaced and/or located within cartridge 400.

Thus, the shape and arrangement of the susceptor 420 is such that the primary flow path through the internal passageways 430 is not substantially blocked by the susceptor 420 or the liquid transport element 410. Thus, the primary flow path through the internal passageways 430 may flow around/past the susceptor 420 and liquid transport element 410.

FIGS. 8A-8D illustrate another example implementation of an atomizer in the form of an inductive heating assembly in a cartridge 500. The cartridge 500 may have a similar external structure to that illustrated in FIG. 6, and may comprise a proximal end 502 and a distal end 504. The cartridge 500 of the depicted implementation in FIGS. 8A-8D further includes an atomizer in the form of an induction heating assembly 506, which comprises a resonant receiver in the form of a susceptor 508. The reservoir or reservoir chamber 510 contains the aerosol precursor composition 512 configured to form the aerosol upon application of heat thereto. The reservoir 510 may define two opposing ends. A first open end of the reservoir 510A is arranged toward the distal end 504 of the cartridge 500 and an opposing second open end of the reservoir 510B is arranged toward the proximal end 502 of the cartridge 500. A liquid transport element 514 having a first end 514A in fluid communication with the reservoir 510 so as to transport the aerosol precursor composition 512 from the reservoir 510 and into an opposing second end 514B of the liquid transport element 514 is also shown. The first end 514A of the liquid transport element 514 may extend into the second open end 510B of the reservoir, so as to act as a wick. In this manner, the liquid transport element 514 may be, for example, in the form of a porous monolith.

As used herein, a "porous monolithic material" or "porous monolith" is intended to mean comprising a substantially single unit which, in some embodiments, may be a single piece formed, composed, or created without joints or seams and comprising a substantially, but not necessarily rigid, uniform whole. In some embodiments, a monolith according to the present disclosure may be undifferentiated, i.e., formed of a single material, or may be formed of a plurality of units that are permanently combined, such as a sintered conglomerate. Thus, in some embodiments the porous monolith may comprise an integral porous monolith.

In some embodiments, the use of a porous monolith particularly can relate to the use of a porous glass in components of an aerosol delivery device, such as the liquid transport element 514. As used herein, "porous glass" is intended to refer to glass that has a three-dimensional interconnected porous microstructure. The term specifically can exclude materials made of bundles (i.e., wovens or non-wovens) of glass fibers. Thus, porous glass can exclude fibrous glass. Porous glass may also be referred to as controlled pore glass (CPG) and may be known by the trade name VYCOR®. Porous glass suitable for use according to the present disclosure can be prepared by known methods such as, for example, metastable phase separation in borosilicate glasses followed by liquid extraction (e.g., acidic extraction or combined acidic and alkaline extraction) of one of the formed phases, via a sol-gel process, or by sintering of glass powder. The porous glass particularly can be a high-silica glass, such as comprising 90% or greater, 95%, 96% or greater, or 98% or greater silica by weight. Porous glass materials and methods of preparing porous glass that can be suitable for use according to the present disclosure are described in U.S. Pat. No. 2,106,744 to Hood et al., U.S. Pat. No. 2,215,039 to Hood et al., U.S. Pat. No. 3,485,687 to Chapman et al., U.S. Pat. No. 4,657,875 to Nakashima et al., U.S. Pat. No. 9,003,833 to Kotani et al., U.S. Pat. Pub. No. 2013/0045853 to Kotani et al., U.S. Pat. Pub. No. 2013/0067957 to Zhang et al., U.S. Pat. Pub. No. 2013/0068725 to Takashima et al., and U.S. Pat. Pub. No. 2014/0075993 to Himanshu, the disclosures of which are incorporated herein by reference. Although the term porous "glass" may be used herein, it should not be construed as limiting the scope of the disclosure in that a "glass" can encompass a variety of silica based materials.

The porous glass can be defined in some embodiments in relation to its average pore size. For example, the porous glass can have an average pore size of about 1 nm to about 1000 μm, about 2 nm to about 500 μm, about 5 nm to about 200 μm, or about 10 nm to about 100 μm. In certain embodiments, porous glass for use according to the present disclosure can be differentiated based upon the average pore size. For example, a small pore porous glass can have an average pore size of 1 nm up to 500 nm, an intermediate pore porous class can have an average pore size of 500 nm up to 10 μm, and a large pore porous glass can have an average pore size of 10 μm up to 1000 μm. In some embodiments, a large pore porous glass can preferably be useful as a storage element, and a small pore porous glass and/or an intermediate pore porous glass can preferably be useful as a transport element.

The porous glass also can be defined in some embodiments in relation to its surface area. For example, the porous glass can have a surface area of at least 100 $m^2/g$, at least 150 $m^2/g$, at least 200 $m^2/g$, or at least 250 $m^2/g$, such as about 100 $m^2/g$ to about 600 $m^2/g$, about 150 $m^2/g$ to about 500 $m^2/g$, or about 200 $m^2/g$ to about 450 $m^2/g$.

The porous glass can be defined in some embodiments in relation to its porosity (i.e., the volumetric fraction of the material defining the pores). For example, the porous glass can have a porosity of at least 20%, at least 25%, or at least 30%, such as about 20% to about 80%, about 25% to about 70%, or about 30% to about 60% by volume. In certain embodiments, a lower porosity may be desirable, such as a porosity of about 5% to about 50%, about 10% to about 40%, or about 15% to about 30% by volume. The porous glass can be further defined in some embodiments in relation to its density. For example, the porous glass can have a density of 0.25 $g/cm^3$ to about 3 $g/cm^3$, about 0.5 $g/cm^3$ to about 2.5 $g/cm^3$, or about 0.75 $g/cm^3$ to about 2 $g/cm^3$.

In some embodiments, the use of a porous monolith particularly can relate to the use of a porous ceramic in components of an aerosol delivery device, such as the liquid transport element 514. As used herein, "porous ceramic" is intended to refer to a ceramic material that has a three-dimensional interconnected porous microstructure. Porous ceramic materials and methods of making porous ceramics suitable for use according to the present disclosure are described in U.S. Pat. No. 3,090,094 to Schwartzwalder et al., U.S. Pat. No. 3,833,386 to Frisch et al., U.S. Pat. No. 4,814,300 to Helferich, U.S. Pat. No. 5,171,720 to Kawakami, U.S. Pat. No. 5,185,110 to Kunikazu et al., U.S. Pat. No. 5,227,342 to Anderson et al., U.S. Pat. No. 5,645,891 to Liu et al., U.S. Pat. No. 5,750,449 to Niihara et al., U.S. Pat. No. 6,753,282 to Fleischmann et al., U.S. Pat. No. 7,208,108 to Otsuka et al., U.S. Pat. No. 7,537,716 to Matsunaga et al., U.S. Pat. No. 8,609,235 to Hotta et al., the disclosures of which are incorporated herein by reference. Although the term porous "ceramic" may be used herein, it should not be construed as limiting the scope of the disclosure in that a "ceramic" can encompass a variety of alumina based materials.

The porous ceramic likewise can be defined in some embodiments in relation to its average pore size. For example, the porous ceramic can have an average pore size of about 1 nm to about 1000 μm, about 2 nm to about 500 μm, about 5 nm to about 200 μm, or about 10 nm to about 100 μm. In certain embodiments, porous ceramic for use according to the present disclosure can be differentiated based upon the average pore size. For example, a small pore porous ceramic can have an average pore size of 1 nm up to 500 nm, an intermediate pore porous ceramic can have an average pore size of 500 nm up to 10 μm, and a large pore porous ceramic can have an average pore size of 10 μm up to 1000 μm. In some embodiments, a large pore porous ceramic can preferably be useful as a storage element, and a small pore porous ceramic and/or an intermediate pore porous ceramic can preferably be useful as a transport element.

The porous ceramic also can be defined in some embodiments in relation to its surface area. For example, the porous ceramic can have a surface area of at least 100 $m^2/g$, at least 150 $m^2/g$, at least 200 $m^2/g$, or at least 250 $m^2/g$, such as about 100 $m^2/g$ to about 600 $m^2/g$, about 150 $m^2/g$ to about 500 $m^2/g$, or about 200 $m^2/g$ to about 450 $m^2/g$.

The porous ceramic can be defined in some embodiments in relation to its porosity (i.e., the volumetric fraction of the material defining the pores). For example, the porous ceramic can have a porosity of at least 20%, at least 25%, or at least 30%, such as about 20% to about 80%, about 25% to about 70%, or about 30% to about 60% by volume. In certain embodiments, a lower porosity may be desirable, such as a porosity of about 5% to about 50%, about 10% to about 40%, or about 15% to about 30% by volume.

The porous ceramic can be further defined in some embodiments in relation to its density. For example, the porous ceramic can have a density of 0.25 $g/cm^3$ to about 3 $g/cm^3$, about 0.5 $g/cm^3$ to about 2.5 $g/cm^3$, or about 0.75 $g/cm^3$ to about 2 $g/cm^3$.

Although silica-based materials (e.g., porous glass) and alumina-based materials (e.g., porous ceramic) may be discussed separately herein, it is understood that a porous monolith, in some embodiments, can comprise a variety of aluminosilicate materials. For example, various zeolites may be utilized according to the present disclosure. Thus, by way of example, the porous monoliths discussed herein may comprise one or both of a porous glass and a porous ceramic, which may be provided as a composite. In one embodiment such a composite may comprise $SiO_2$ and $Al_2O_3$.

A porous monolith used according to the present disclosure can be provided in a variety of sizes and shapes. Preferably, the porous monolith may be substantially elongated, substantially flattened or planar, substantially curved (e.g., "U-shaped"), substantially in the form of a walled cylinder, or in any other form suitable for use according to the present disclosure. Additional example shapes of the porous monolith are described hereinafter and illustrated in the figures.

In one or more embodiments, a porous monolith according to the present disclosure can be characterized in relation to wicking rate. As a non-limiting example, wicking rate can be calculated by measuring the mass uptake of a known liquid, and the rate (in mg/s) can be measured using a microbalance tensiometer or similar instrument. Preferably, the wicking rate is substantially within the range of the desired mass of aerosol to be produced over the duration of a puff on an aerosol forming article including the porous monolith. Wicking rate can be, for example, in the range of about 0.05 mg/s to about 15 mg/s, about 0.1 mg/s to about 12 mg/s, or about 0.5 mg/s to about 10 mg/s. Wicking rate can vary based upon the liquid being wicked. In some embodiments, wicking rates as described herein can be referenced to substantially pure water, substantially pure glycerol, substantially pure propylene glycol, a mixture of water and glycerol, a mixture of water and propylene glycol, a mixture of glycerol and propylene glycol, or a mixture of water, glycerol, and propylene glycol. Wicking rate also can vary based upon the use of the porous monolith. For example, a porous monolith used as a liquid transport element may have a greater wicking rate than a porous monolith used as a reservoir. Wicking rates may be varied by control of one or more of pore size, pore size distribution, and wettability, as well as the composition of the material being wicked.

Accordingly, in the depicted implementation, the liquid transport element 514 and the reservoir 510 are two separate components. However, in some other example implementations, the liquid transport element 514 and the reservoir 510 are unitary such that there is not a separate reservoir, and instead, the unitary liquid transport element and reservoir contains the aerosol precursor composition and be axially and circumferentially positioned by the susceptor 508. The term "unitary," as used herein with respect to the context of the unitary reservoir and liquid transport element, refers to the reservoir and liquid transport element being a formed continuous piece, with a seamless transition from the reservoir to the liquid transport element. In this regard, the unitary reservoir and liquid transport element may comprise the porous monolith such as a porous glass or porous ceramic as described above, which may be integral. Thereby, the susceptor 508 may heat the aerosol precursor composition contained by the unitary reservoir and liquid transport element to produce vapor.

The susceptor 508 may be arranged and configured to be heated by the resonant transmitter 230. In some implementations, the susceptor 508 may comprise a ferromagnetic material including, but not limited to, cobalt, iron, nickel, zinc, manganese, and any combinations thereof. In some implementations, one or more components of the susceptor may be made of other materials, including, for example, other metal materials such as aluminum or magnetic stainless steel (e.g., 400 series stainless steels such as, 410, 430, 440C), non-magnetic stainless steel, (e.g., 302 SS), or non-stainless steel varieties, like ceramic materials such as silicon carbide, and any combinations of any of the materials described above. In still other implementations, the susceptor may comprise other conductive materials including metals such as copper, alloys of conductive materials, or other materials with one or more conductive materials imbedded therein. In some implementations, the susceptor 508 may comprise a granulated susceptor component, including, but not limited to a shredded susceptor material. In other implementations, a granulated susceptor component may comprise susceptor particles, susceptor beads, etc.

In some example implementations, the susceptor 508 comprises an active portion 508A through which the liquid transport element 514 extends. At least the active portion 508A of the susceptor 508 may be arranged to heat the liquid transport element 514 and thereby heat the aerosol precursor composition 512 therein to form the aerosol. Opposing ends 508B, 508C of the susceptor 508 circumferentially and axially position the active portion 508A of the susceptor 508 within the cartridge 500 and relative to the liquid transport element 514, and/or an outer housing 516 and the reservoir 510. The active portion 508A of the susceptor 508 is positioned between the two opposing ends 508B, 508C. Positioning or arranging the susceptor 508 circumferentially or axially may permanently position the susceptor relative to the liquid transport element 514, and/or the outer housing 516 and the reservoir 510, or may removably position it, such that the susceptor 508 may be repositioned or removed. Movement of the cartridge 500 and/or aerosol delivery device during the ordinary course of use should not change the position of the susceptor 508, such that the susceptor 508 is sufficiently retained in position unless intentionally repositioned.

In particular, and as illustrated in FIG. 8B, for example, the susceptor 508 is in the form of a longitudinally-extending coil with an internal diameter that is larger than an external diameter of the liquid transport element 514. In various implementations, the individual coils may have any pitch spacing. In the depicted implementation, the individual coils of the susceptor 508 may be spaced apart from one another with a pitch of the helix being between about 1.5 to about 1.75 mm; and in some implementations, about 1.65 mm. Where the liquid transport element 514 is formed as a porous monolith, the susceptor 508 is arranged around and circumscribes at least a portion of the liquid transport element 514. The liquid transport element 514 may also have another shape or form that is not a porous monolith, and may be comprised of cotton, a ceramic material, and the like. For example, the liquid transport element 514 may be a strip of material that is wrapped around the active portion 508A of the susceptor 508 and then positioned in fluid communication with the reservoir 510. In some implementations, the susceptor may be imbedded or partially imbedded in the liquid transport element 514.

The resonant transmitter 230, which may be located proximate at least a portion of a receiving chamber (e.g., receiving chamber 212 in FIG. 5) may substantially surround at least the active portion 508A of the susceptor 508. For example, where the resonant transmitter 230 is in the form of an inductive coil, the coils thereof may encircle at least the active portion 508A of the susceptor 508. Thus, the aerosol precursor composition 512 is transported through the liquid transport element 514 (e.g., by capillary action) from the first end 514A to the second end 514B, and heated by the active portion 508A of the susceptor 508 when the active portion 508A of the susceptor 508 is energized by the resonant transmitter 230.

In the depicted implementation, the cartridge 500 includes an outer housing 516 that at least partially circumscribes the reservoir 510, the liquid transport element 514, and the susceptor 508. In the depicted implementation, the outer housing 516 is constructed as a tubular structure that substantially encapsulates the aerosol precursor composition 512; however, as noted above, in other implementations the outer housing may have other shapes. Although the shape of the outer housing may vary, in the depicted implementation the outer housing 516 comprises a tubular structure having opposed closed ends with openings defined therethrough.

In the depicted implementation, and as shown in FIG. 8C, the outer housing 516 of the cartridge 500 includes an end cap 518 defining end apertures 520 and arranged to cover or substantially cover the proximal end 502 of the outer housing/cartridge 500. The end apertures 520 are configured to allow air to pass through and intermingle with the aerosol generated by the inductive heating assembly 506. The end apertures 520 of the depicted implementation are in the form of four elongated openings; however, in other implementations the end apertures may have any form that permits passage of the air therethrough. As such, it will be appreciated that the end apertures 520 can comprise fewer or additional apertures and/or alternative shapes and sizes of apertures than those illustrated.

The end cap 518 may be arranged proximate to a second end 508C of the susceptor 508 so that it engages the outer housing 516 and encloses (substantially covers) the second end 508C of the susceptor 508 therein. The end cap 518 may engage the outer housing 516 in a variety of ways, including, for example, via one or more of a snap-fit, interference fit, screw thread, magnetic, and/or bayonet connection. In other implementations, the end cap 518 may be integral with the outer housing 516 and thus may not be separable. The end cap 518 may be formed of any suitable material including a moldable plastic material such as, for example, polycarbonate, polyethylene, acrylonitrile butadiene styrene (ABS), polyamide (Nylon), or polypropylene. In other implementations, the end cap 518 may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof.

Further still, in the depicted implementation, and more particularly shown in FIG. 8D, a plug 522 is arranged relative to the distal end 504 of the outer housing/cartridge 500 so as to cover or substantially cover the first open end 510A of the reservoir 510. The first open end 510A of the reservoir may define a central opening arranged in a central area of the reservoir 510 and in which the plug 522 is arranged. The first open end 510A of the reservoir may also define a plurality of circumferentially extending openings 524 arranged around the central opening. As shown in the depicted implementation, there are four openings 524. The centrally openings 524 may be so formed so as to allow aerosol or vapor pass through the circumferentially extending openings 524 and through, for example, the passageway 228 of the main body 212 of the holder 200 (FIG. 5). The plug 522 may engage the reservoir 510 in a variety of ways, including, for example, via one or more of a snap-fit, interference fit, screw thread, magnetic, and/or bayonet connection. In other implementations, the plug 522 may be integral with the reservoir 510 and thus may not be separable. The plug 522 may be formed of any suitable material including a resilient polymeric material, such as, for example, silicone, or may be a plastic material such as, for example, polycarbonate, polyethylene, acrylonitrile butadiene styrene (ABS), polyamide (Nylon), or polypropylene. In other implementations, the plug 522 may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof.

Although in other implementations the size and shape of the end apertures 520 and the circumferentially extending openings 524 may differ, the circumferentially extending openings 524 and the end apertures 520 of the depicted implementation may each comprise a plurality of elongate rounded slots circumferentially extending about a central area of each respective end. In the depicted implementation, the circumferentially extending openings 524 may be in fluid communication with the end apertures 520 of the end cap 518 via internal passageways 526, which extend between an exterior surface of the reservoir and an interior surface of the outer housing 516. It should be noted that in other implementations, there may be one internal passageway or multiple internal passageways 426 that may take other forms and/or sizes. For example, in some implementations, there may be one internal passageway, two external passageways, three external passageways, four external passageways, and the like. Still other implementations may include no internal passageways at all. Additional implementations may include multiple internal passageways that may be of unequal diameter and/or shape and which may be unequally spaced and/or located within cartridge 500.

Thus, the shape and arrangement of the susceptor 520 is such that the primary flow path through the internal passageways 530 is not substantially blocked by the susceptor 520 or the liquid transport element 514. Thus, the primary flow path through the internal passageways 530 may flow around/past the susceptor 520 and liquid transport element 514.

As noted, in various implementations, the holder may include an aerosol passageway that extends therethrough. In the depicted implementation in FIG. 5, for example, the aerosol passageway 228 extends from the cartridge receiving chamber 212 through the main body 202 and mouthpiece portion 204 of the holder 200. As such, upon a draw applied to the mouthpiece portion 204 of the holder 200, aerosol generated by the cartridge is configured to be delivered to a user. In some implementations, the aerosol passageway extends from the cartridge receiving chamber to the mouthpiece portion of the holder in a substantially direct path. For example, in some implementations, the aerosol passageway may extend from the cartridge receiving chamber through the holder along a path that is aligned with, or substantially parallel to, a longitudinal axis thereof. In other implementations, however, the aerosol passageway may have a less direct route. For example, the aerosol passageway of some implementations may define an indirect route from the cartridge receiving chamber through the holder, such as, for example, via one or more tortuous paths. In some implementations, for example, such a path may allow the aerosol to cool before reaching a user. In some implementations, such a path may allow mixing of the aerosol with air from outside of the holder. In some implementations, such a path may comprise a serpentine pattern. In other implementations, such a path may include one or more sections that overlap and/or double back toward each other. In other implementations, such a path may comprise one or more spiral turns that extend around an inner diameter of the holder. Other implementations may include combinations of tortuous aerosol paths. Still other implementations may include combinations of direct and tortuous path sections.

In some implementations, the mouthpiece portion, or other portion of the holder may include a filter configured to receive the aerosol therethrough in response to the draw applied to the holder. In various implementations, the filter may be provided, in some aspects, as a circular disc radially and/or longitudinally disposed proximate the end of the holder opposite the receiving end. In this manner, upon a draw on the holder, the filter may receive the aerosol flowing through holder. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the mouthpiece portion may include a filter that may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942; U.S. Pat. App. Pub. No. 2019/0289909 to Hejazi; and U.S. Pat. App. Pub. No. 2020/0288787 to Hejazi, each of which is incorporated by reference herein in its entirety.

In some implementations, the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, an aerosol precursor composition may produce a visible aerosol upon the application of sufficient heat thereto (and cooling with air, if necessary), and the aerosol precursor composition may produce an aerosol that is "smoke-like." In other aspects, the aerosol precursor composition may produce an aerosol that is substantially non-visible but is recognized as present by other characteristics, such as flavor or texture. Thus, the nature of the produced aerosol may be variable depending upon the specific components of the aerosol delivery component. The aerosol precursor composition may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally, or alternatively, include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)). It should be noted that the aerosol precursor composition may comprise any constituents, derivatives, or combinations of any of the above.

As noted herein, the aerosol precursor composition may comprise or be derived from one or more botanicals or constituents, derivatives, or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the aerosol precursor composition may comprise an active compound naturally existing in a botanical, obtained synthetically. The aerosol precursor composition may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens*.

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the aerosol precursor composition and/or those regions of the smoking article where an aerosol is generated. In some implementations, such agents may be supplied directly to a heating cavity or region proximate to the heat source or are provided with the aerosol precursor composition. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

As used herein, the terms "flavor," "flavorant," "flavoring agents," etc. refer to materials which, where local regulations permit, may be used to create a desired taste, aroma, or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some implementations, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some implementations, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Flavoring agents may also include acidic or basic characteristics (e.g., organic acids, such as levulinic acid, succinic acid, pyruvic acid, and benzoic acid). In some implementations, flavoring agents may be combinable with the elements of the aerosol precursor composition if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the aerosol precursor composition. Organic acids particularly may be able to be incorporated into the aerosol precursor composition to affect the flavor, sensation, or organoleptic properties of medicaments, such as nicotine, that may be able to be combined with the aerosol precursor composition. For example, organic acids, such as levulinic acid, lactic acid, pyruvic acid, and benzoic acid may be included in the aerosol precursor composition with nicotine in amounts up to being equimolar (based on total organic acid content) with the nicotine. Any combination of organic acids may be suitable. For example, in some implementations, the aerosol precursor composition may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the aerosol precursor composition. Various additional examples of organic acids employed to produce an aerosol precursor composition are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In the depicted implementations, the holder includes walls that are substantially solid and non-porous; however, in other implementations one or more of these walls of a holder may have other configurations. For example, in some implementations one or more of the walls of a holder may be non-solid and/or substantially porous or may include one or more non-solid and/or substantially porous portions. Alternatively, or additionally, other implementations may include one or more apertures that may mix with the aerosol generated by the aerosol precursor composition of the cartridge.

In various implementations, the present disclosure may also be directed to kits that provide a variety of components as described herein. For example, a kit may comprise a holder with one or more cartridges. In another implementation, a kit may comprise a holder with one or more sleeves. In another implementation, a kit may comprise a main body with one or more mouthpiece portions. In another implementation, a kit may comprise a mouthpiece portion with one or more main bodies. In another implementation, a kit may comprise a plurality of holders. In further implementations, a kit may comprise a plurality of cartridges. In another implementation, a kit may comprise a plurality of sleeves. In yet another implementation, a kit may comprise a plurality of holders and a plurality of cartridges. In another implementation, a kit may comprise a plurality of cartridges and a plurality of sleeves. In another implementation, a kit may comprise a plurality of holders and a plurality of sleeves. In another implementation, a kit may comprise a plurality of holders, a plurality of cartridges, and a plurality of sleeves. The inventive kits may further include a case (or other packaging, carrying, or storage component) that accommodates one or more of the further kit components. The case could be a reusable hard or soft container. Further, the case could be simply a box or other packaging structure. In some implementations, a brush or other cleanout accessory may be included in a kit. The cleanout accessory may be configured to be inserted in a cartridge receiving chamber of the holder, or, in other implementations, inserted in a separate aperture that enables a user to remove debris from the cartridge receiving chamber.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a cartridge comprising:

a reservoir containing an aerosol precursor composition configured to form an aerosol upon application of heat thereto, a liquid transport element having a first end in fluid communication with the reservoir so as to transport the aerosol precursor composition from the reservoir and into an opposing second end of the liquid transport element; and a susceptor having an active portion around which at least the second end of the liquid transport element extends, at least the active portion of the susceptor being arranged to heat the second end of the liquid transport element and thereby heat the aerosol precursor composition therein to form the aerosol; and a holder comprising a main body defining a receiving chamber configured to receive the cartridge, and a resonant transmitter located proximate at least a portion of the receiving chamber, the resonant transmitter extending around at least a portion of the receiving chamber, wherein opposing ends of the susceptor circumferentially and axially position the active portion of the susceptor within the cartridge, and wherein the opposing ends of the susceptor are circumferentially turned ends with the active portion longitudinally-extending therebetween, and wherein the first end of the liquid transport element defines at least one opening extending from the first end of the liquid transport element and at least partially along a longitudinal length thereof, the first circumferentially turned end of the susceptor extending through the at least one opening such that the first end of the liquid transport element extends through the first circumferentially turned end of the susceptor.

2. The aerosol delivery device of claim 1, wherein the opposing ends of the susceptor circumferentially and axially position the active portion of the susceptor relative to the liquid transport element.

3. The aerosol delivery device of claim 1, wherein the cartridge includes an outer housing that at least partially circumscribes the reservoir, the liquid transport element, and the susceptor.

4. The aerosol delivery device of claim 3, wherein the opposing ends of the susceptor circumferentially and axially position the active portion of the susceptor relative to the outer housing and reservoir.

5. The aerosol delivery device of claim 3, further comprising an end cap defining end apertures and arranged to cover a distal end of the outer housing.

6. The aerosol delivery device of claim 3, further comprising a plug arranged relative to an opposing proximal end of the outer housing so as to cover a first open end of the reservoir, the first end of the liquid transport element extending into an opposing second open end of the reservoir.

7. The aerosol delivery device of claim 1, wherein the opposing ends of the susceptor are circumferentially turned ends with the active portion longitudinally-extending therebetween.

8. The aerosol delivery device of claim 1, wherein the liquid transport element defines an opening through which at least a portion of the susceptor extends.

9. The aerosol delivery device of claim 1, wherein the second end of the liquid transport element is wrapped around the active portion of the susceptor.

* * * * *